US010617263B2

(12) United States Patent
Ophardt et al.

(10) Patent No.: US 10,617,263 B2
(45) Date of Patent: Apr. 14, 2020

(54) LIQUID HAND CLEANER FOAM DISPENSING AS SPRAY AND LIQUID STREAM

(71) Applicant: OP-Hygiene IP GmbH, Niederbipp (CH)

(72) Inventors: Heiner Ophardt, Arisdorf (CH); Andrew Jones, St. Anns (CA); Zhenchun Shi, Hamilton (CA)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/246,779

(22) Filed: Jan. 14, 2019

(65) Prior Publication Data

US 2019/0142228 A1 May 16, 2019

Related U.S. Application Data

(63) Continuation of application No. 15/248,869, filed on Aug. 26, 2016, now Pat. No. 10,238,241.

(30) Foreign Application Priority Data

Sep. 1, 2015 (CA) ..... 2902754

(51) Int. Cl.

| | |
|---|---|
| ***A47K 5/12*** | (2006.01) |
| ***B05B 15/62*** | (2018.01) |
| ***B05B 12/02*** | (2006.01) |
| ***B05B 7/00*** | (2006.01) |

(Continued)

(52) U.S. Cl.

CPC ..... *A47K 5/1211* (2013.01); *A47K 5/1207* (2013.01); *B05B 1/14* (2013.01); *B05B 7/0025* (2013.01); *B05B 11/0086* (2013.01); *B05B 11/3001* (2013.01); *B05B 11/3084* (2013.01); *B05B 11/3085* (2013.01); *B05B 11/3087* (2013.01); *B05B 11/3088* (2013.01); *B05B 12/02* (2013.01); *B05B 15/62* (2018.02); *B05B 11/3057* (2013.01)

(58) Field of Classification Search

CPC ..... A47K 5/1211; A47K 5/1207; B05B 1/14; B05B 7/0025; B05B 12/02; B05B 15/62; B05B 11/0086; B05B 11/3001; B05B 11/3084–3085; B05B 11/3087–3088; B05B 11/3057

USPC ..... 222/190, 383.1, 321.7–321.9

See application file for complete search history.

(56) References Cited

U.S. PATENT DOCUMENTS

| | | | |
|---|---|---|---|
| 4,817,651 | A | 4/1989 | Crisp |
| 5,165,577 | A | 11/1992 | Ophardt |
| 5,265,628 | A | 11/1993 | Sage |

(Continued)

FOREIGN PATENT DOCUMENTS

| | | |
|---|---|---|
| CN | 103908183 | 7/2014 |
| GB | 2502248 | 11/2013 |
| WO | 2012042243 | 4/2012 |

*Primary Examiner* — Paul R Durand
*Assistant Examiner* — Andrew P Bainbridge
(74) *Attorney, Agent, or Firm* — Thorpe North & Western, LLP

(57) ABSTRACT

Operating a hand cleaner dispenser for dispensing a cleaning liquid from a reservoir onto a person's hands in a cycle of operation wherein, during a first time interval during the cycle dispensing the liquid onto the hand as a spray, and during a second time interval during the cycle dispensing the liquid onto the hand as a liquid stream.

9 Claims, 17 Drawing Sheets

(51) Int. Cl.
*B05B 1/14* (2006.01)
*B05B 11/00* (2006.01)

(56) References Cited

U.S. PATENT DOCUMENTS

| | | | | |
|---|---|---|---|---|
| 5,676,277 | A | 10/1997 | Ophardt | |
| 6,110,292 | A | 8/2000 | Jewett | |
| 6,601,736 | B2 | 8/2003 | Ophardt et al. | |
| 7,267,251 | B2 | 9/2007 | Ophardt | |
| 7,303,099 | B2 | 12/2007 | Ophardt | |
| 7,556,178 | B2 | 7/2009 | Ophardt | |
| 7,823,751 | B2 * | 11/2010 | Ophardt | B05B 7/0037 222/136 |
| 8,360,286 | B2 | 1/2013 | Shi et al. | |
| 8,365,965 | B2 | 2/2013 | Ophardt | |
| 8,474,664 | B2 | 7/2013 | Ophardt et al. | |
| 8,893,932 | B2 | 11/2014 | Ophardt et al. | |
| 8,919,611 | B2 | 12/2014 | Ophardt et al. | |
| 10,238,241 | B2 * | 3/2019 | Ophardt | A47K 5/1207 |
| 2007/0278247 | A1 | 12/2007 | Banks et al. | |
| 2009/0179083 | A1 | 7/2009 | Chou | |
| 2010/0051650 | A1 | 3/2010 | Chou | |
| 2011/0240680 | A1 | 10/2011 | Ophardt et al. | |
| 2014/0259382 | A1 | 9/2014 | Dobizi et al. | |
| 2015/0291345 | A1 * | 10/2015 | Ophardt | A47K 5/1207 222/401 |
| 2019/0142228 | A1 * | 5/2019 | Ophardt | A47K 5/1207 |

* cited by examiner

LIQUID HAND CLEANER FOAM DISPENSING AS SPRAY AND LIQUID STREAM

RELATED APPLICATION

This application is a continuation of co-pending U.S. patent application Ser. No. 15/248,869 filed Aug. 26, 2016 and claims the benefit of 35 U.S.C. 120.

SCOPE OF THE INVENTION

This invention relates to dispensing of hand cleaners and, preferably, to dispensing of liquid during at least two time intervals during a cycle of operation and, in one aspect, to dispensing hand cleaners both as a liquid stream onto a palm of a hand and as a liquid spray onto the fingertips of a hand.

BACKGROUND OF THE INVENTION

Hand cleaning soap dispensers are known in which a liquid hand cleaner is dispensed onto the upturned palm of a user. A disadvantage of many hand cleaning dispensers is that hand cleaning liquid is dispensed as, for example, downwardly onto an upwardly directed palm of a user. The user must then manipulate their hands to rub the cleaning liquid to their fingers and over their fingertips. The applicant has appreciated the disadvantage that typical patterns that persons use for rubbing the cleaning liquid into their hands do not adequately distribute the cleaning liquid over the fingers and particularly over the fingertips. The applicant has appreciated that for proper cleaning and disinfecting of a user's hands as in the medical and food industries, it is advantageous to apply cleaners to not only the palm of the hand but also the fingers and particularly the fingertips.

The present applicant has appreciated that hand cleaning soap dispensers are known which suffer the disadvantage that a liquid hand cleaner is dispensed merely in a single time interval during a cycle of operation.

SUMMARY OF THE INVENTION

To at least partially overcome some of these disadvantages of previously known devices, the present invention provides for liquid hand cleaner dispensing during a first time interval as a spray and during a second time interval as a liquid stream, preferably, with the spray being directed onto the user's hand and, preferably, the fingertips and the liquid being directed into the palm of the user's hand.

To at least partially overcome some of these disadvantages of previously known devices, the present invention provides for liquid hand cleaner dispensing in a cycle of operation during both a first time interval and during a second time interval.

In a first aspect, the present invention provides a method of operating a hand cleaner dispenser for dispensing a cleaning liquid from a reservoir onto a person's hands in a cycle of operation wherein:

during a first time interval during the cycle dispensing the liquid onto the hand as a spray; and during a second time interval during the cycle dispensing the liquid onto the hand as a liquid stream.

In a second aspect, the present invention provides a hand cleaner dispenser for dispensing a cleaning fluid from a reservoir onto a person's hand in a cycle of operation wherein during a first time interval during the cycle, the dispenser dispenses the liquid onto the hand as a spray, preferably directed towards the fingers and the fingertips and, during a second time interval during the cycle, the dispenser dispenses the liquid onto the hand as a liquid stream, preferably onto the palm of a user's hand. The dispenser preferably incorporates a piston pump which provides for the sequence dispensing of the spray and the liquid stream.

In a third aspect, the present invention provides a pump arrangement for dispensing from two or more different discharge outlets in a desired sequencing of discharge from each outlet towards providing advantageous application of cleaning liquids onto a person's hand for cleaning of the entire hand including the fingertips. The sequencing of discharge is preferably arranged by use of a pumping mechanism with arrangements which provide for selective diversion of liquid to each outlet with time. The same liquid may be discharged from each outlet as, selectively, a liquid spray, a liquid stream, a foamed mixture of liquid and air, and a sprayed mixture of liquid and air.

Preferably, in accordance with the first, second and third aspects of the present invention, the discharge outlets are relatively located spaced from each other, or directed, relative to a person's hand to dispense a liquid spray onto a person's fingers and/or fingertips and a liquid stream or foamed liquid stream onto a person's palm.

In a fourth aspect, the present invention provides a dispenser, a pump arrangement and a method of operating a piston pump in a hand cleaner dispenser to dispense a cleaning liquid from onto a person's hands in a cycle of operation comprising a retraction stroke and a withdrawal stroke including dispensing both during a first time interval during the cycle, and during a second time interval during the cycle.

In a fifth aspect, the present invention provides for a dispenser, a pump arrangement and a method of liquid dispensing preferably of a liquid hand cleaner in a cycle of operation in which there is dispensing in a first time interval and dispensing in a second time interval preferably different than the first time interval. The first time interval may overlap with the second time interval or may not overlap. The same liquid may be dispensed in each time interval or different liquids may be dispensed during each time interval. The liquid dispensed during each time interval may be dispensed from different outlets or dispensed from the same outlet. The liquid dispensed in each time interval may be dispensed as a liquid stream, as a liquid spray, or as a foam of liquid and air. When dispensing is with a piston pump, both the first time interval and the second time interval may be in the same stroke or the first time interval may be in a different stroke than the second time interval.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
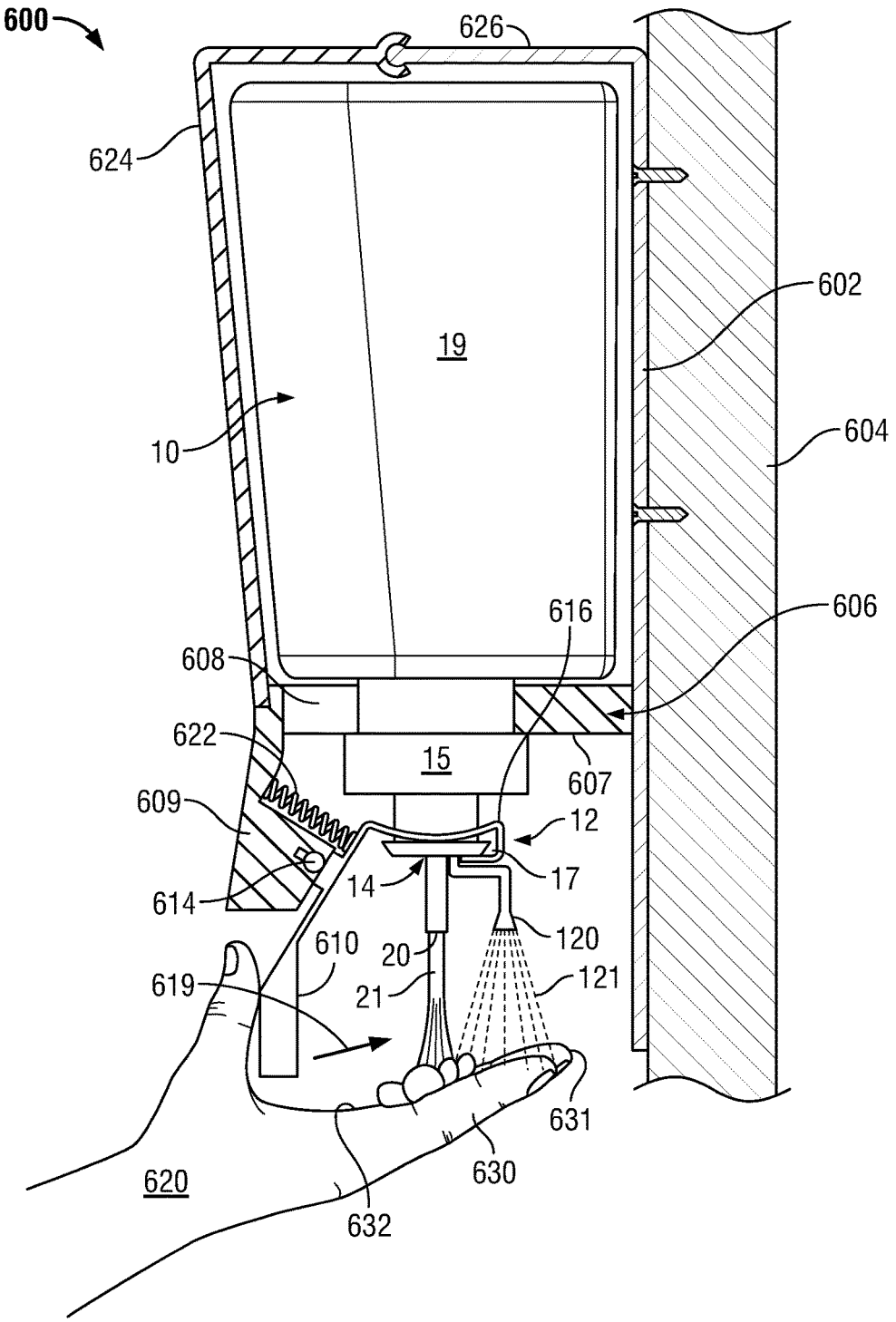
FIG. 1 is a partially cutaway schematic side view of a first embodiment of a hand cleaner dispenser including a removable and replaceable cartridge comprising a reservoir assembly and a pump assembly in accordance with the present invention.

Reference is made to FIG. 1 which schematically shows in side view a manually operated hand cleaner foam dispenser 600 in accordance with the present invention. The dispenser 600 is adapted to removably receive a cartridge 10. In FIG. 1, the dispenser 600 is shown in side cross-section other than an activating lever 610 which is schematically shown in side view and not cross-sectioned. In FIG. 1, a user's hand 620 and the cartridge 10 are also shown in side view and not cross-sectioned.

In FIG. 1, the dispenser 600 includes a back plate 602 as for mounting of the dispenser 600 to a building wall 604. A support plate 606 extends forwardly from the back plate 604 to support and receive the cartridge 10. The support plate 606 has a rear portion 607, two side arms 608 (only one of which is seen) and a forward portion 609. The side arms 608 extend forwardly from the rear portion 607 to support the forward portion 609 forming a lower front wall of the dispenser 600. The support plate 606 has an opening extending downwardly therethrough defined between the side arms 608 and between the forward portion 609 and the rear portion 607 via which opening 612 the cartridge 10 may be inserted downwardly and then slid rearwardly for secure engagement of the cartridge 10 on the support plate 606. The activating lever 610 is journalled to the forward portion 609 for pivoting about a horizontal axis 614. An upper end of the lever 610 carries a hook 616 to engage an engagement flange 17 on a piston-forming element 14 of the pump assembly 12 and couple the lever 610 to the piston-forming element 14 such that by movement of a lower handle end of the lever 610 in the direction indicated by the arrow 619 manually by the hand 620 of a user slides the piston-forming element 14 relative a piston chamber-forming body 15 of the pump assembly 12 upwardly and inwardly in a retraction stroke to the retracted position shown in FIG. 1 thereby dispensing a liquid 39 downwardly onto the user's hand 620. On release of the lower handle end of the lever 610, a spring 622 biases the upper end of the lever 610 downwardly so that the lever 610 moves the piston-forming element 14 relative the body 15 outwardly in an extension stroke to an extended position not shown in FIG. 1. A cover member 624 is hinged at 625 to an upper forward extension 626 of the back plate 604 so as to permit manual removal and replacement of the cartridge 10.

As seen schematically in FIG. 1, the cartridge 10 includes the pump assembly 12 and a reservoir 19 containing a cleaning liquid to be dispensed. The piston-forming element 14 of the pump assembly 12 carries a spray discharge outlet 120 to discharge the liquid as a spray 121 onto the fingers 630 and fingertips 631 of the user's hand 620 and a liquid discharge outlet 20 to discharge the liquid as a liquid stream 21 onto the upturned palm 632 and fingers 630 of the user's hand 620.

Figure 2:
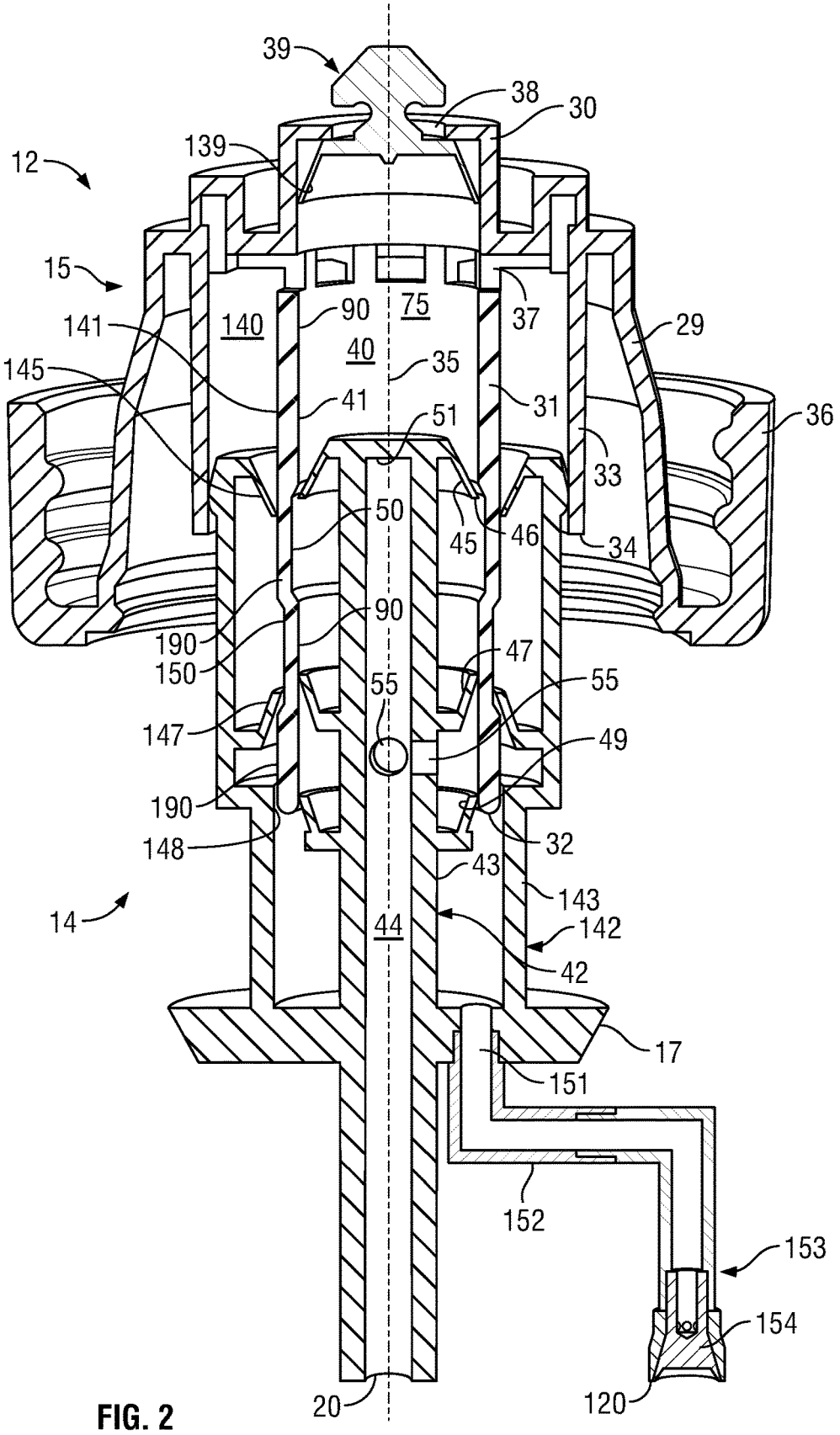
FIG. 2 is a cross-sectional front view of the first embodiment of the pump assembly shown in FIG. 1 but with the piston-forming element in an extended position relative to the piston chamber-forming body.
Figure 3:
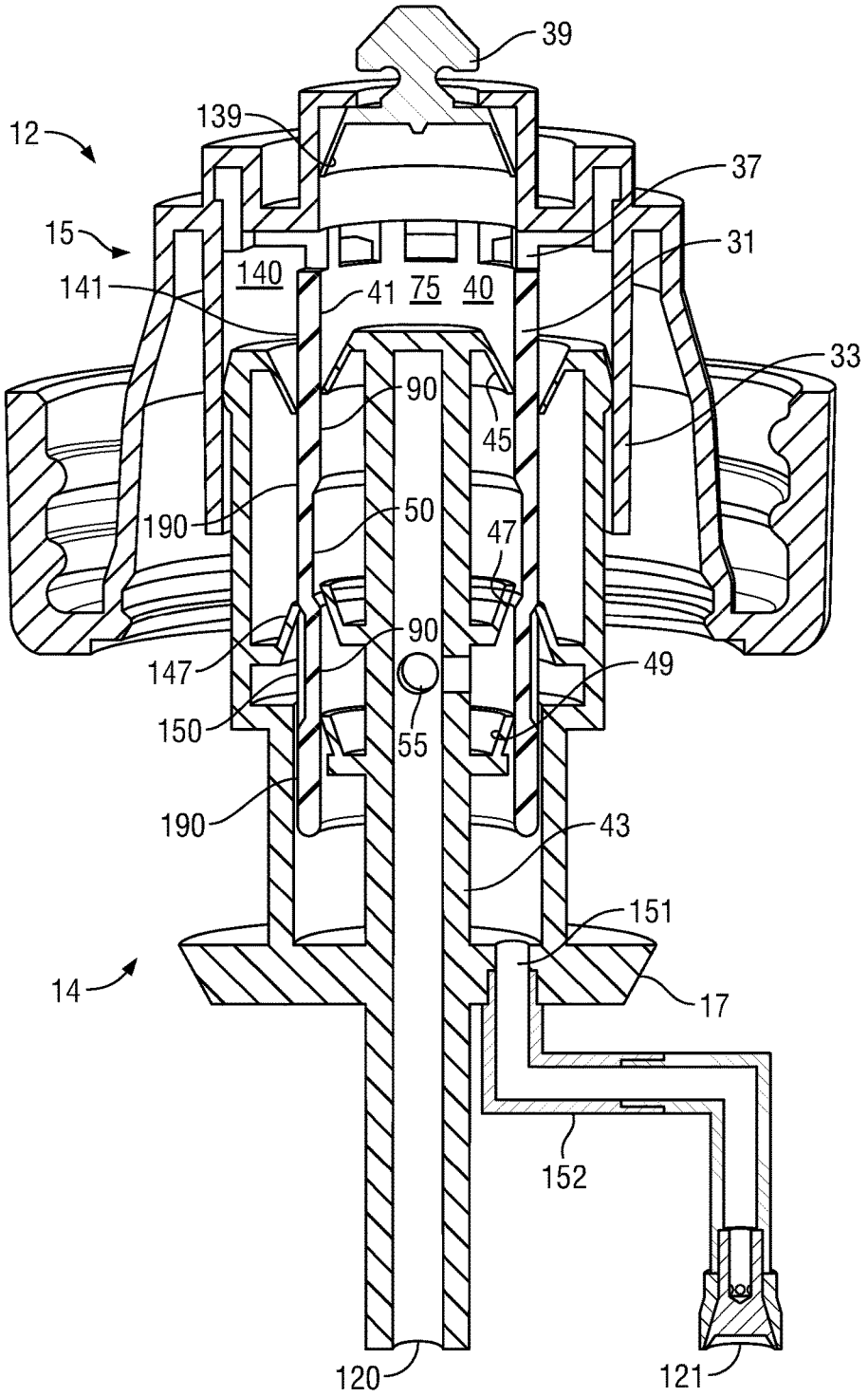
FIG. 3 is a cross-sectional front view of the pump assembly as in FIG. 2 but with the piston-forming element in an intermediate position relative to the piston chamber-forming body.
Figure 4:
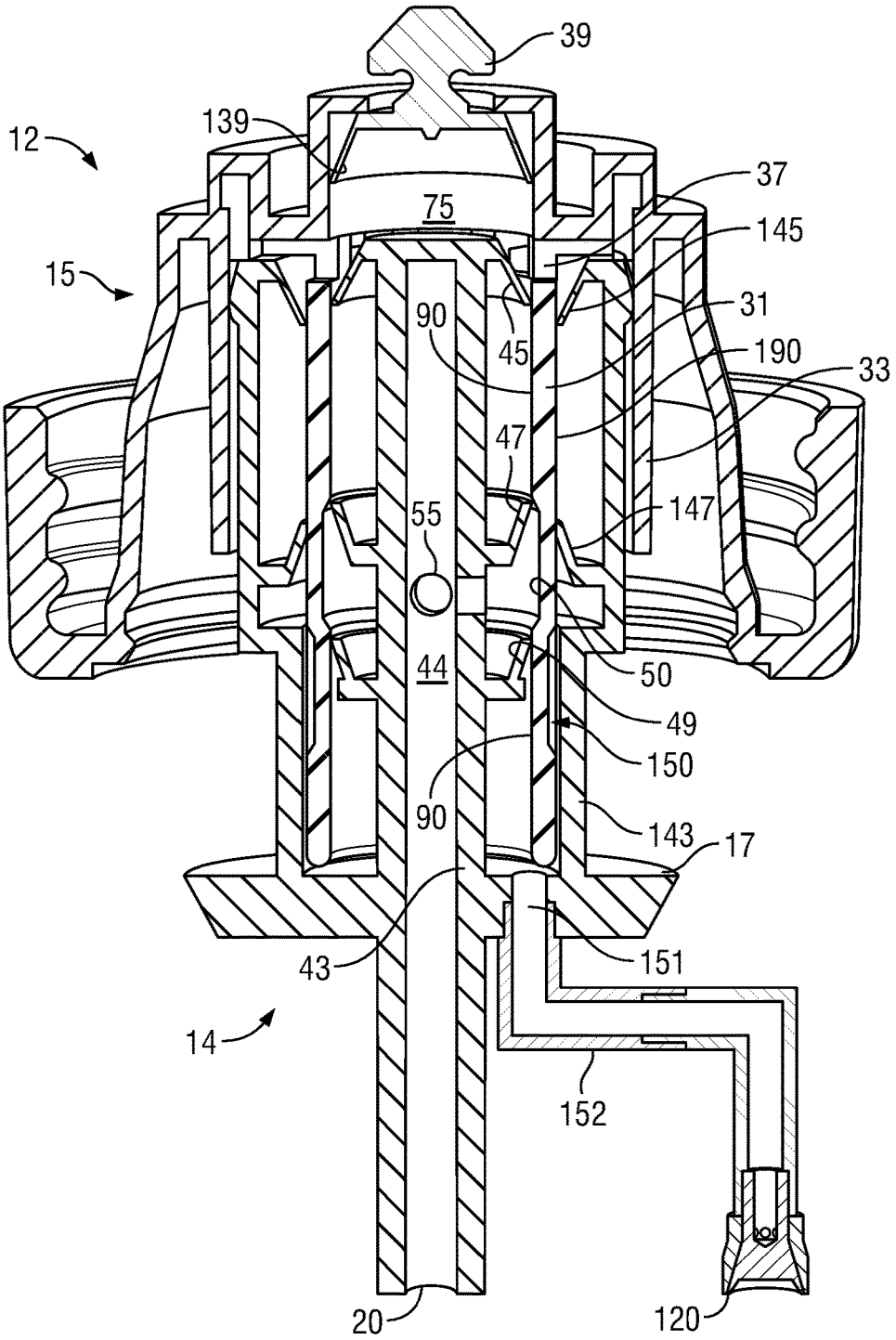
FIG. 4 is a cross-sectional front view of the pump assembly as in FIG. 2 but with the piston-forming element in a retracted position relative to the piston chamber-forming body.

Reference is made to FIGS. 2, 3 and 4 which show the first embodiment of the pump assembly 12 of FIG. 1 in cross-sectional front view in which the piston-forming element 14 is respectively in an extended position, an intermediate position and a retracted position relative to the piston chamber-forming body 15.

The piston chamber-forming body 15 has an end wall 30 from which a cylindrical inner tube 31 extends to an open inner end 32. A cylindrical outer tube 33 extends from the end wall 30 to an open outer end 34. The inner tube 31 and the outer cylindrical tube 33 are coaxially disposed about a common axis 35. The inner tube 31 has a radially inwardly directed inner wall 41 comprising cylindrical first sealing portions 90 of a first diameter and a first annular groove 50 having an increased diameter compared to the first sealing portions 90. The inner tube 31 has a radially outwardly directed outer wall 141 comprising cylindrical second sealing portions 190 of a second diameter and a second annular groove 150 having a reduced diameter compared to the second sealing portions 190.

The end wall 30 also carries a support wall 29 disposed coaxially about the axis 35 to support a threaded flange 36 for sealably engaging on a neck of the reservoir 19, not shown.

A first liquid chamber 40 is provided within the inner tube 31 and an annular second liquid chamber 140 is provided in an annular space between the inner tube 31 and the outer tube 33. Radially extending openings 37 through the inner tube 31 provide for communication between the first liquid chamber 40 and the second liquid chamber 140. At an inner end of the first liquid chamber 40, an inlet opening 38 is provided in communication with fluid within the reservoir. A one-way liquid valve 39 is disposed across the inlet opening 38 to provide for liquid flow from the reservoir 19 into the first liquid chamber 40 yet to prevent liquid flow from the first liquid chamber 40 to the reservoir 19 by reason of the one-way inlet valve 39 carrying a resilient valve disc 139 which engages an inner wall 41 of the inner tube 31.

The engagement flange 17 of the piston-forming element 14 carries both a first liquid piston 42 coaxially disposed within the first liquid chamber 40 and an annular second liquid piston 142 coaxially disposed within the annular second liquid chamber 140.

The piston-forming element 14 is coaxially slidable relative to the piston chamber-forming body 15 about the axis 35 for movement in a cycle of operation including a retraction stroke and an extension stroke. In a retraction stroke, the piston-forming element 14 moves from the extended position of FIG. 2 through the intermediate position of FIG. 3 to the retracted position of FIG. 4. In an extension stroke, the piston-forming element 14 moves from the retracted position of FIG. 4 through the intermediate position of FIG. 3 to the extended position of FIG. 2.

The first liquid piston 42 has a hollow stem 43 with a central passageway 44 therethrough leading to the first or liquid discharge outlet 20. The first liquid piston 42 carries a first inner disc 45 which engages with the first liquid chamber 40 to permit the liquid to merely flow outwardly therepast and to prevent liquid flow axially inwardly therepast.

The first liquid piston 42 carries axially outwardly from the first inner disc 45 a first intermediate disc 47 which engages with the inner tube 31 to selectively permit or prevent fluid flow depending upon the axial location of the first liquid piston 42 within the first liquid chamber 40. The first intermediate disc 47 is provided such that when it engages the cylindrical first sealing portions 90 of the inner wall 41, the first intermediate disc 47 prevents fluid flow axially outwardly therebetween. However, when the first intermediate disc 47 is disposed within the first annular groove 50, fluid flow is permitted axially inwardly and outwardly through an annular gap between a distal end of the first intermediate disc 47 and the first annular groove 50. On the stem 43 between the first intermediate disc 47 and the first outer disc 49 radially extending ports 55 are provided providing communication from an annular space between the first intermediate disc 47 and the first outer disc 49 into the central passageway 44.

The first liquid piston 42 carries axially outwardly from the first intermediate disc 47 a first outer disc 49 which engages the first sealing portions 90 of the inner wall 41 of the inner tube 31 to prevent fluid flow axially inwardly and outwardly therebetween. The central passageway 44 is open at the first discharge outlet 20 and closed at an inner end 51.

The annular second liquid piston 142 has a cylindrical hollow stem 143 disposed coaxially between the outer tube 33 and the inner tube 31. The stem 143 carries a second inner disc 145 which extends radially inwardly from the second stem 143 for engagement with the second sealing portions 190 of the outer wall 141 of the inner tube 31 to form a one-way valve permitting liquid flow therebetween axially outwardly but preventing liquid flow axially inwardly. The second liquid piston 142 carries axially outwardly of the second inner disc 145 a second intermediate disc 147 which extends radially inwardly for engagement with the inner tube 31 to selectively permit or prevent fluid flow depending upon the axial location of the second liquid piston 142 within the second liquid chamber 140. The second intermediate disc 147 engages the cylindrical second sealing portions 190 of the outer wall 141 to prevent fluid flow axially inwardly or outwardly therepast. When the second intermediate disc 147 is disposed within the second annular groove 150, fluid flow is permitted axially inwardly and outwardly through an annular gap between a distal end of the second intermediate disc 147 and the second annular groove 150.

Axially outwardly from the second intermediate disc 147, the second stem 143 is spaced radially inwardly from the outer tube 33 providing an annular passageway 148 permitting fluid flow at all times axially outwardly of the second intermediate disc 147 between the second stem 143 and the outer tube 33 to an annular space between the outer tube 33 and the inner tube 31 open to a second liquid outlet 151 axially through the engagement flange 17 and connected by a second discharge tube 152 to a spray nozzle 153 carrying the second or spray discharge outlet 120. The spray nozzle 153 carries a nozzle plug 154 with circumferentially spaced narrow passageways such that when the liquid is directed under pressure through the spray nozzle 153, the liquid is discharged from the second discharge outlet 120 as a spray of liquid 121 typically having relatively small droplets of the liquid forming a spray or mist as shown on FIG. 1.

Operation of the pump assembly 12 of FIGS. 2 to 4 is now described. From the extended position as seen in FIG. 2, the piston-forming element 14 is moved inwardly from the extended position of FIG. 2 to the intermediate position of FIG. 3 and during this movement, the first intermediate disc 47 prevents flow of liquid axially outwardly through the first liquid chamber 40, however, the second intermediate disc 147 is within the second annular groove 150 and permits flow of liquid axially outwardly therepast in the second liquid chamber 140. A liquid compartment 75 is defined within the first liquid chamber 40 axially inwardly from the first inner disc 45 and within the annular second liquid chamber 140 axially inwardly of the second inner disc 145 with communications provided between the first liquid chamber 40 and the second liquid chamber 140 via the openings 37. The volume of the liquid compartment 75 decreases in the retraction stroke and increases in the extension stroke. In the extension stroke, in moving from the extended position of FIG. 2 to the intermediate position of FIG. 3, the liquid within the liquid compartment 75 is pressurized and forced past the second inner disc 145 and past the second intermediate disc 147 to flow via the second liquid outlet 151 and the second discharge tube 152 out the spray discharge outlet 120 as a spray 121. The first intermediate disc 47 prevents fluid flow outwardly therepast in the first liquid chamber 40 while the first intermediate disc 47 engages the cylindrical first sealing portions 90 of the inner wall 41.

On reaching the intermediate position as shown in FIG. 3, the second intermediate disc 147 comes to move axially inwardly out of the second annular groove 150 and the first intermediate disc 47 comes to be received within the first annular groove 50. In movement in the retraction stroke from the intermediate position of FIG. 3 to the retracted position of FIG. 4, liquid within the liquid compartment 75 is pressurized and forced axially outwardly past the first inner disc 45 and axially outwardly past the first intermediate disc 47 which is within the first annular groove 50 into the annular space about the stem 43 between the first intermediate disc 47 and the first outer disc 49 and through the radially extending ports 55 through the stem 43 into the central passageway 44 and out the discharge outlet 20 as a liquid stream 21. In a retraction stroke in moving from the intermediate position of FIG. 3 to the retracted position of FIG. 4, the second intermediate disc 147 engages the cylindrical second sealing portions 190 of the outer wall 141 to prevent fluid flow axially therebetween.

In an extension stroke in moving from the position of FIG. 2 to the position of FIG. 4, the volume of the liquid compartment 75 increases drawing liquid from the reservoir 19 past the valve disc 139 of the one-way liquid valve 39 from the reservoir 19.

In the retraction stroke, there is a first interval during which the first intermediate disc 47 is received within the first annular groove 50 and fluid is discharged out the first discharge outlet 20, and a second interval during which the second intermediate disc 145 is within the second annular groove 150 and fluid is discharged out the spray discharge outlet 120. In the first embodiment of FIGS. 2 to 4, in a retraction stroke, the second interval occurs first followed by the first interval such that there is discharge of the liquid spray 121 before the liquid stream 21. This is preferred but not necessary. The second interval may follow the first interval as by relative axial location of the first annular groove 50 compared to the second annular groove 150. The second interval ends at a time when the first interval starts. In FIGS. 2 to 4, there is a small axial extent to which the first interval and the second interval overlap when there is simultaneous discharge out of both the first discharge outlet 20 and the second discharge outlet 120. The relative axial extent of each of the first interval and the second interval and the extent to which the first interval and the second interval overlap may be suitably selected.

The relative axial length of the first interval and the second interval can be selected so as to select the ratio of the liquid that is discharged out of the first discharge outlet 20 as compared to the second discharge outlet 120 in a stroke of operation. For example, in a preferred arrangement, the liquid discharged out the second discharge outlet 120 may represent 10% to 40%, more preferably, ⅕ to ⅓ of the total liquid dispensed from both the first discharge outlet 20 and the second discharge outlet 120 in a stroke of operation.

In the preferred embodiment of FIGS. 2 to 4, each of the first interval and the second interval comprise merely a portion of the entire stroke. In accordance with the present invention, it is possible to select the first interval to be the entire length of the stroke, that is, for example, to provide for discharge from the first discharge outlet 20 during the entirety of the retraction stroke and for discharge from the second discharge outlet 120 merely during a portion of the retraction stroke. Conversely, the second interval may provide for discharge from the second discharge outlet 120 during the entirety of the stroke and merely for discharge from the first discharge outlet 20 during a portion of the stroke. In the case that is desired, for example, to discharge liquid from the first discharge outlet 20 during the entirety of the stroke then, rather than increase the axial length of the first annular groove 50, the pump assembly 12 can be modified so as to eliminate the first annular groove 50 and to eliminate the first intermediate disc 47. Similarly, in the event it is desired that liquid be discharged through the second discharge outlet 120 during the entirety of the stroke, then this can be accomplished by eliminating the second annular groove 150 and the second intermediate disc 147. It is in accordance with the present invention the pump assembly may also be operated so as to discharge liquid from the first discharge outlet 20 and the second discharge outlet 120 during the entirety of a retraction stroke and this may be accomplished, for example, by eliminating the first annular groove 50, the first intermediate disc 47, the second annular groove 150 and the second intermediate disc 147.

In the first embodiment, the interaction of the first liquid chamber 40 and the first liquid piston 42 form a first liquid pump which has many functional equivalents to a liquid pump as taught in U.S. Pat. No. 5,676,277 to Ophardt, issued Oct. 14, 1997, the disclosure of which is incorporated herein by reference. Various discs such as the first inner disc 45 engage with the walls of a tube so as to permit fluid flow in one direction and to prevent fluid flow in another direction. In this regard, the first inner disc 45 preferably is a resilient member which extends to a distal end 46 such that when a pressure differential is sufficient to deflect the first inner disc 45, its outer edge 46 deflects away from the inner wall 41 permitting fluid flow outwardly therepast. However, when there is increased pressure on an axially outer side of the disc 45, the outer edge 46 engages the inner wall 41 to prevent fluid flow inwardly therepast. The first inner disc 45 is directed radially outwardly and axially outwardly to provide for fluid flow axially outwardly but to prevent fluid flow axially inwardly. The same is true of the second inner disc 145 and the valve disc 139. In contrast, each of the first intermediate disc 47, the first outer disc 49, and the second intermediate disc 147 are directed radially inwardly and axially inwardly towards generally resisting fluid flow outwardly therepast.

The liquid dispensed with the first embodiment is preferably a gel, that is, a liquid which has a viscosity such that the liquid will remain on the palm of the user's hand and not quickly run off. Such hand cleaner gels are well known. When sufficiently pressurized as in discharge out the spray nozzle 153, the gel liquefies and becomes discharges as small particles or droplets.

Figure 5:
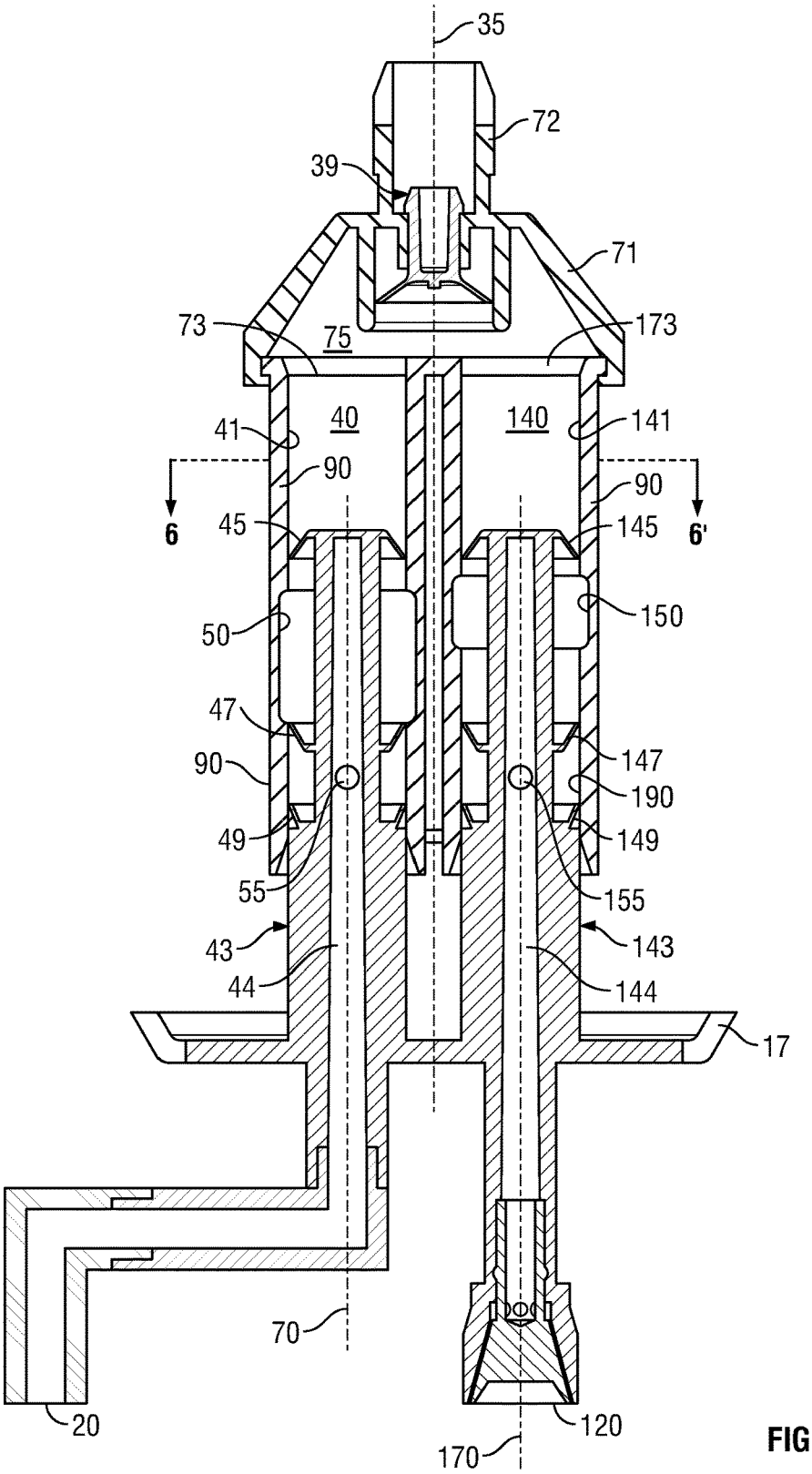
FIG. 5 is a cross-sectional front view of a second embodiment of a pump assembly in accordance with the present invention showing the piston-forming element in an extended condition relative the piston chamber-forming body.
Figure 6:
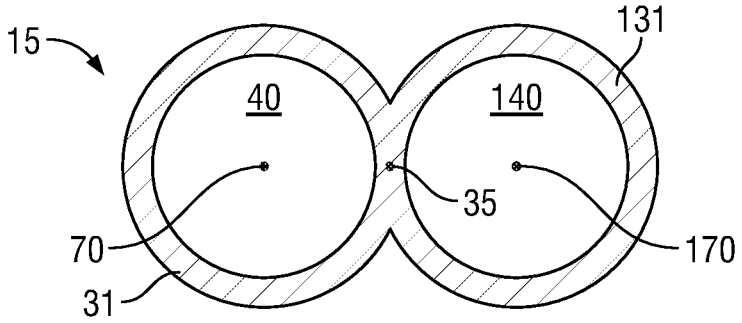
FIG. 6 is a cross-sectional view of the piston chamber-forming element along section line 6-6' in FIG. 5.

Reference is made to FIGS. 5 and 6 which illustrate a second embodiment of a pump assembly 12 in accordance with the present invention. In the second embodiment and all other embodiments, similar reference numerals are used to refer to similar elements.

In the first embodiment of FIGS. 2 to 4, the second liquid chamber 140 is coaxial about the first liquid chamber 40. In the second embodiment of FIGS. 5 and 6, the first liquid chamber 40 is provided within a first tube 31 about a first axis 70 and the second liquid chamber 140 is provided within a second tube 131 about a second axis 170 parallel the first axis and a central axis 35. At an inner end, a header 71 is provided with an inlet tube 72 coaxial about the central axis 35 and carrying a one-way inlet valve 39. The header 71 provides for communication to both an inner open end 73 of the first liquid chamber 40 and an inner open end 173 of the second liquid chamber 140. The first tube 31 has an inner wall 41 carrying cylindrical first sealing portions 90 of a first diameter and a first annular groove 50 of a greater diameter at a suitable axial location. The second tube 131 has an inner wall 141 carrying cylindrical second sealing portions 90 of a second diameter and a second annular groove 150 of a greater diameter at a suitable axial location. A first liquid piston 42 in FIG. 5 is substantially identical to the first liquid piston 42 in FIG. 2 having a hollow stem 43 with a central passageway 44 to provide communication from a first port 55 to the first discharge outlet 20. A first inner disc 45, intermediate disc 47 and outer disc 49 are provided with liquid permitted to transfer axially past the first intermediate disc 47 when the first intermediate 47 disc is received within the first annular groove 50. The second liquid piston 142 is identical to the first liquid piston 42 and has a hollow stem 143, a central passageway 144, a second inner disc 145, a second intermediate disc 147 and second outer disc 149. When the second intermediate disc 147 is received within the second annular groove 150, liquid can flow axially therebetween and, for example, via a second port 155 to the central passageway 144 to the second discharge outlet 120. The first liquid piston 42 and the second liquid piston 142 are supported on an engagement flange 17 which is coaxially disposed about the axis 35.

In FIG. 5, in a retraction stroke the first interval when the first intermediate disc 47 is within the first annular groove 50 occurs before the second interval when the second intermediate disc 147 is within the second annular groove 150 such that there is discharge of the liquid stream 21 before the liquid spray 121. Additionally, the first interval overlaps with the second interval such that in sequence there is, firstly, merely discharge of the liquid stream 21, followed by, secondly, simultaneously discharge of both the liquid stream 21 and the liquid spray 121, followed by, thirdly, merely the discharge of the liquid spray 121.

Figure 7:
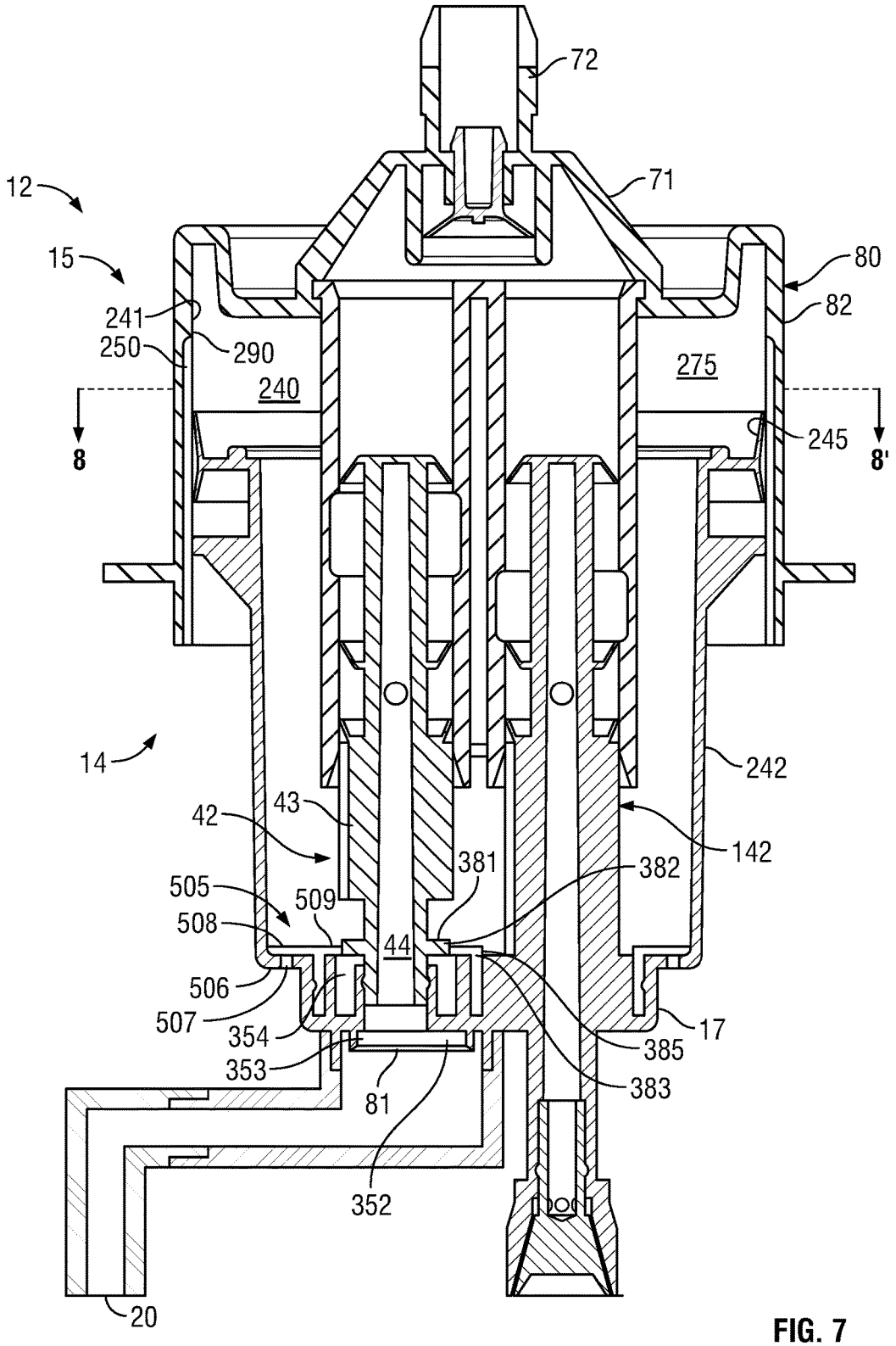
FIG. 7 is a cross-sectional front view of a third embodiment of a pump assembly in accordance with the present invention showing the piston-forming element in an extended condition relative the piston chamber-forming body.
Figure 8:
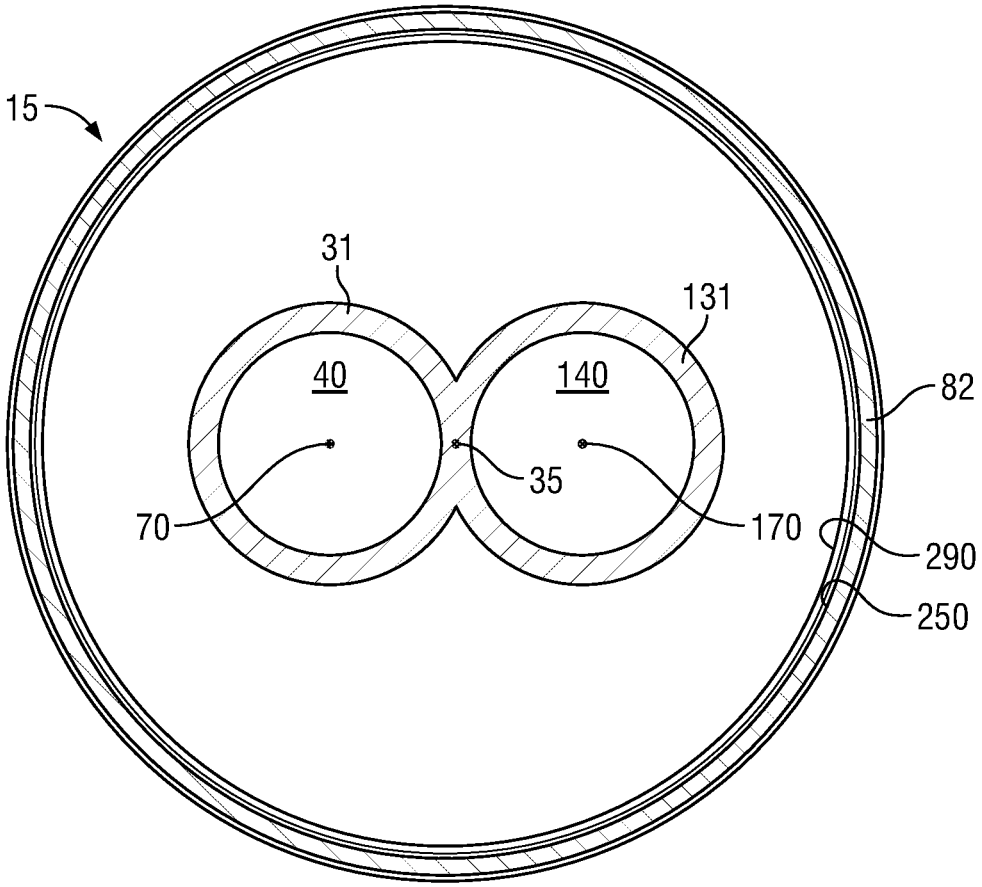
FIG. 8 is a cross-sectional view of the piston chamber-forming element along section line 8-8' in FIG. 7.

Reference is made to FIGS. 7 and 8 which illustrate a third embodiment of a pump assembly 12 in accordance with the present invention. The third embodiment of FIGS. 7 and 8 incorporates the features of the second embodiment of FIGS. 5 and 6, however, adds in addition, an air pump 80 for simultaneous discharge of liquid and air through a foam inducing member 81 for discharge from the first discharge outlet 20 as a foamed product. As seen in FIGS. 7 and 8, the piston chamber-forming body 15 includes a cylindrical air tube 82 coaxially about the axis 35 radially outwardly of the first liquid chamber 40 and second liquid chamber 140 defining an air chamber 240 therein closed at an inner end. The air tube 82 has a radially inwardly directed inner wall 241 comprising a cylindrical third sealing portion 290 of a third diameter and a third annular groove 250 of increased diameter compared to the cylindrical third sealing portion 290. The piston-forming element 14 carries on an engagement flange 17 an axially inwardly extending air piston 242 with an air inner disc 245 adapted to engage the cylindrical third sealing portion 290 of the inner wall 241 of the air tube 231 to prevent air flow inwardly or outwardly therepast. When the air inner disc 245 is within the third annular groove 250, air is free to pass axially therebetween. A variable volume air compartment 275 is defined between the air chamber 240 and the air piston 242 whose volume varies with axial movement of the piston-forming element 14 relative to the piston chamber-forming body 15.

The air pump 80 carries a one way air inlet valve 505 which permits air flow from the atmosphere into the air compartment 275 but prevents fluid flow outwardly from the air compartment 275. In this regard, the air piston 242 has an axially inwardly directed shoulder 506 with spaced air inlet openings 507 through the shoulder 506 providing for communication of the air from the atmosphere into the air compartment 275. The one-way air inlet valve 505 comprises a radially outwardly extending annular disc 508 supported at a radial inner end 509 on a cylindrical outer support ring received within a cylindrical slot about the axis 35 in the engagement flange 17. The disc 508 presents an axially outwardly directed sealing surface 510 which engages the inwardly directed shoulder 506 to form a seal therewith to prevent air flow from the air compartment 275 through the air inlet openings 507. The disc 508 deflects axially inwardly to permit atmospheric air to flow through the air inlet opening 207 into the air compartment 275 as when a vacuum condition is created within the air compartment 275.

The air compartment 275 includes a first one way air outlet valve 380 providing for air flow from the air compartment 275 into a first mixing chamber 352.

As in the embodiment of FIGS. 6 and 7, in FIG. 8, the engagement flange 17 carries both the first liquid piston 42 and the second liquid piston 142. As can be seen, the second liquid piston 142 is shown as being formed integrally with the engagement flange 17. The first liquid piston 42 is formed as a separate element which has an outer end fixedly secured within a stepped opening axially through the engagement flange 17. The stepped opening has a smaller diameter outer annular portion to securely engage annularly about the outer end of the first liquid portion 42. Axially inwardly of the smaller diameter outer annular portion, the stepped opening provides an annular air chamber 354 radially about the stem 43 of the first liquid piston 42 and opening axially inwardly into the air compartment 275. At one circumferential location, there is an air outlet port 352 extending axially outwardly from the annular air chamber 354 into a first mixing chamber 352. The central passageway 44 of the first liquid piston 42 opens axially at its axial outer end into the first mixing chamber 352. A foam inducing member 81 in the form of a screen with small openings therethrough is provided across an axially outer outlet of the first mixing chamber 352. The first liquid piston 42 includes axially inwardly of the annular air chamber 354 a radially outwardly extending annular flange 381 with an axially outwardly directed seat shoulder 382. A resilient annular disc 383 is provided coaxially about the stem 43 immediately axially outwardly from the flange 381 with a central opening of the disc 383 coaxially about the stem 43. The disc 383 carries a radially outer edge 385 on a cylindrical inner support ring received in a cylindrical slot about the axis 70 in the engagement flange 17. The disc 383 is secured against movement to the engagement flange 17 and sealed to prevent flow between the disc 383 and the engagement flange 17. The disc 383 carries an axially inwardly directed sealing surface for engagement with the seat shoulder 382 of the flange 381 to prevent flow of air and/or liquid axially inwardly therepast. The disc 383 is resiliently deflectable axially outwardly away from the seat shoulder 382 to permit air flow axially outwardly from the air compartment 275 into the annular air chamber 354 and hence via the port 352 into the first mixing chamber 352.

In a retraction stroke of the piston-forming element 14 during a third interval when the air inner disc 245 is engaged with the third sealing portion 290, the air pump 80 pressurizes the air compartment 275 closing the one-way air inlet valve 505 and opening the first one-way outlet valve 380 forcing air into the first mixing chamber 352. The third interval is provided simultaneously with at least a portion of the first interval when the first intermediate disc 47 is in the first annular groove 50 and liquid is discharged through the first liquid piston 42 so that air and liquid are discharged into the first mixing chamber 352 and simultaneously through the foam inducing member 81 to produce a foamed product which is discharged from out the first discharge outlet 20. In the third interval, air is discharged to the first mixing chamber 352 and in the first interval when liquid is discharged to the first mixing chamber 352. The third interval and the first interval may stop and start at the same time. The third interval may overlap with the first interval and, preferably to some extent, overlaps with the first interval such that a foam product is produced at least during a portion of the stroke. For example, selection of the intervals can be such that there is merely discharged a liquid stream followed by discharge of air and liquid as foam or vice versa. Additionally, the continued discharge of air after the first liquid piston 42 no longer discharges liquid can be advantageous towards discharge of residual liquid from the mixing chamber 352 and discharging tubes.

Figure 9:
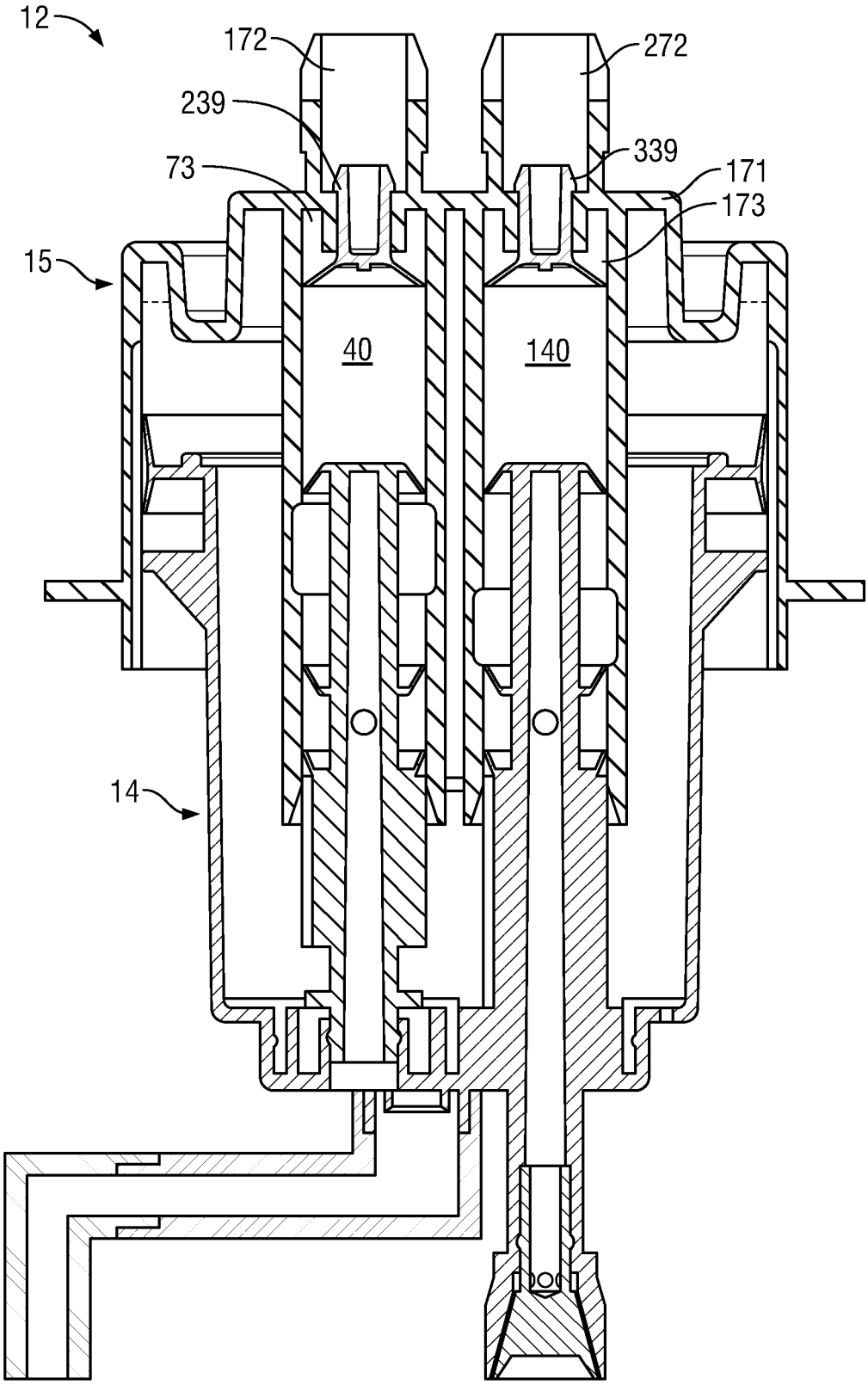
FIG. 9 is a cross-sectional front view of a fourth embodiment of a pump assembly in accordance with the present invention showing the piston-forming element in an extended condition relative the piston chamber-forming body.

In the third embodiment, an inlet end of the first liquid chamber 40 and an inlet end of the second liquid chamber 140 are connected by a header 71 to a single inlet tube 72 for connection to a single reservoir. This is not necessary and the first liquid chamber 40 may be connected to a first reservoir containing a first liquid and the second liquid chamber 140 may be connected to a second reservoir containing a second liquid. In this regard, reference is made to FIG. 9 which illustrates a fourth embodiment of a pump assembly in accordance with the present invention and which is identical to the third embodiment as shown in FIGS. 7 and 8, however, in which the header 71 of FIG. 6 has been replaced by a modified header 171 which isolates the open inner end 73 of the first liquid chamber 40 from the open inner end 173 of the second liquid chamber 140 and provides two separate inlet tubes 172 and 272 each for preferred connection to a different reservoir which may contain different liquids. As seen, two separate inlet valves are provided, namely a first one-way inlet valve 239 leading to the first liquid chamber 40 and a second one-way inlet valve 339 leading to the second liquid chamber 140. Otherwise, operation of the fourth embodiment of FIG. 9 is the same as with the third embodiment of FIGS. 7 and 8.

Figure 10:
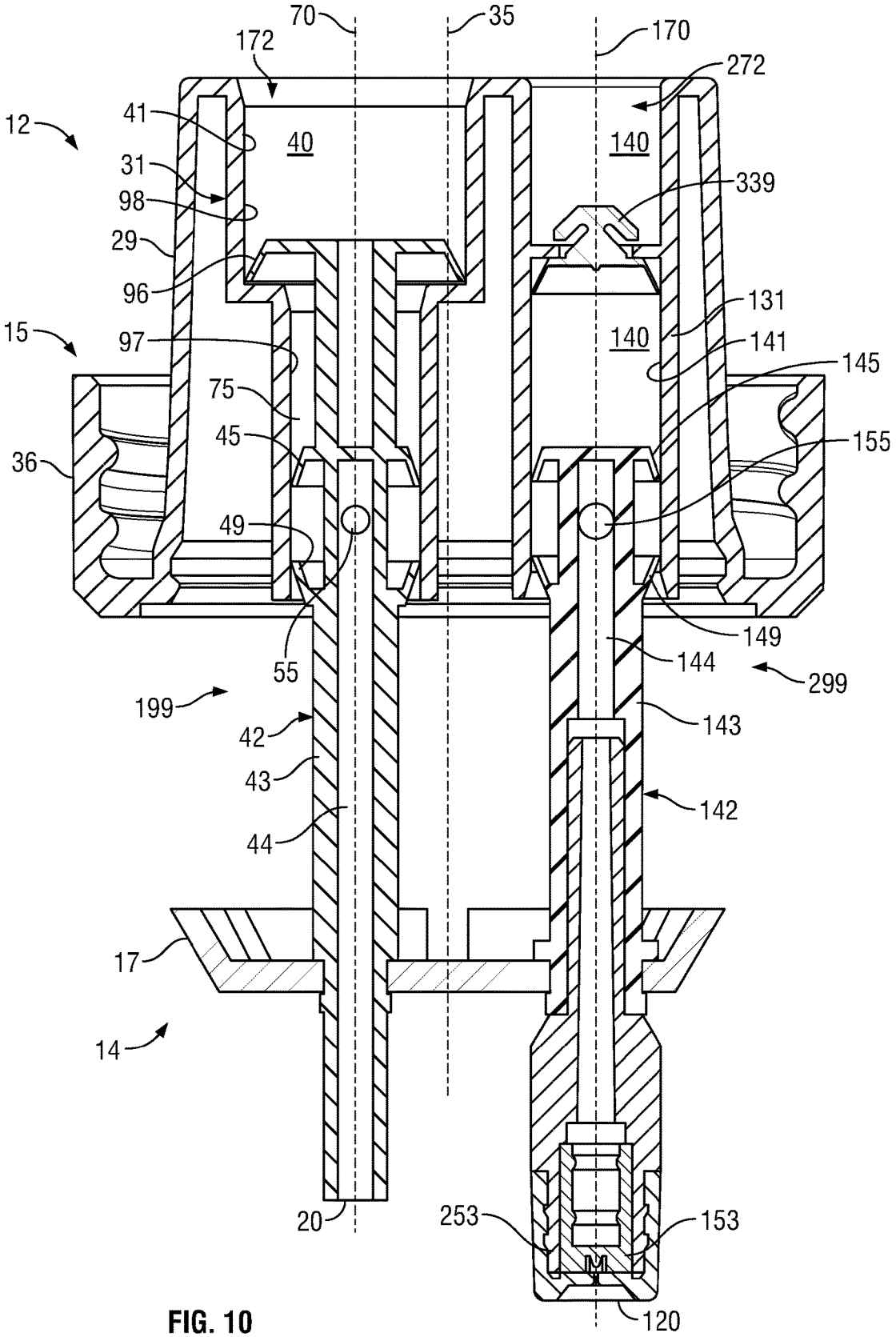
FIG. 10 is a cross-sectional front view of a fifth embodiment of a pump assembly in accordance with the present invention showing the piston-forming element in an extended condition relative the piston chamber-forming body.

Reference is made to FIG. 10 which illustrates a fifth embodiment of a pump assembly 12 in accordance with the present invention. The embodiment of FIG. 10 has many close similarities to the embodiment of FIG. 9. Similar reference numerals are used to refer to similar elements. As seen in FIG. 10, within the piston chamber-forming body 15 a first liquid chamber 40 is provided within a stepped first tube 31 disposed about a first axis 70 and a second liquid chamber 140 is provided within a second tube 131 about a second axis 170 parallel the first axis 70 and a central axis 35. As seen in FIG. 10, a support wall 29 and threaded flange 36 of the piston chamber-forming body 15, as well as an engagement flange 17 of the piston-forming element 14, are axially about the central axis 35. A second piston 142 together with the second liquid chamber 140 form a second liquid pump 299 substantially identical to that formed within the chamber 140 of FIG. 9, however, with the elimination of the intermediate disc 145 in FIG. 9. In FIG. 10, the second liquid chamber 140 carries at an axially inner end a separate second one-way inlet valve 339 permitting fluid flow therepast merely outwardly. The second tube 131 has an inner wall 141 which is generally cylindrical. The second liquid piston 142 has a hollow stem 143 with a central passageway 144 to provide communication from a second port 155 to a second discharge outlet 120. A second inner disc 145 and a second outer disc 149 are provided on the second stem 143. The second inner disc 145 permits fluid flow merely axially outwardly therepast and the second outer disc 149 prevents fluid flow axially inwardly and outwardly therepast. At all times during a retraction stroke of the piston-forming element 14, the second pump 299 discharges liquid from the second discharge outlet 120 through a spray nozzle 153 for discharge as a liquid spray. In FIG. 10 as in the other Figures, the provision of the spray nozzle 153 is optional. The spray nozzle 153 may be eliminated such that a second liquid stream is discharged out the second discharge outlet 120.

The stepped first tube 31 has an inner wall 41 which is stepped having an enlarged cylindrical first inner portion 98 of a first diameter and a cylindrical second outer portion 97 of a reduced diameter less than the first diameter. The first liquid piston 42 has a hollow stem 43 with a central passageway 44 to provide communication from a first port 55 to a first discharge outlet 20. A first enlarged interior disc 96 is carried on the first liquid piston 42 for engagement with the inner wall 41 of the first tube 31 within the enlarged first inner portion 98 to permit fluid flow merely axially outwardly therepast. The first liquid piston 42 carries a first inner disc 45 and a first outer disc 49. The first inner disc 45 permits fluid flow merely axially outwardly therepast and the first outer disc 49 prevents fluid flow axially inwardly and outwardly therepast. The first port 55 is provided on the stem axially between the first inner disc 45 and the first outer disc 49. A variable volume first liquid compartment 75 is defined within the first chamber 40 between the interior disc 96 and the first outer disc 49. The volume of the first liquid compartment 75 increases in a withdrawal stroke and decreases in a retraction stroke. As a result, in a retraction stroke, liquid is drawn into the axially inner end of the first liquid chamber 40 and, in a withdrawal stroke, liquid is discharged through the first port 55 to the first passageway 44 and out the first discharge outlet 20 as a liquid stream. The first liquid piston 42 cooperates with the piston chamber-forming body 15 to form a first liquid pump 199 which operates to discharge liquid in a withdrawal stroke. In contrast, the second liquid piston 142 cooperates with the piston chamber-forming body 15 to form the second liquid pump 299 which serves to discharge liquid from the second discharge outlet in a retraction stroke.

Each of the first liquid piston 42 and the second liquid piston 142 are coupled to the engagement flange 17 for simultaneous movement together as the piston-forming element 14. A cycle of operation comprises a withdrawal stroke and an extension stroke. During a cycle of operation, in a first interval comprising, the withdrawal stroke, liquid is discharged from the first discharge outlet 20 and, in a second interval, the retraction stroke, liquid is discharged from the second discharge outlet 120. Thus, the first liquid pump 199 and the second liquid pump 299 are out of phase with each other. In FIG. 10, the first liquid chamber 40 has a separate inlet opening 172 and the second liquid chamber 140 has a second inlet opening 272. The pump of FIG. 10 may be utilized with the inlet openings 172 and 272 coupled to the same reservoir as to dispense the same liquid or, alternatively, each of the inlets 172 and 272 may be coupled to different reservoirs which can, for example, may carry different liquids.

Figure 11:
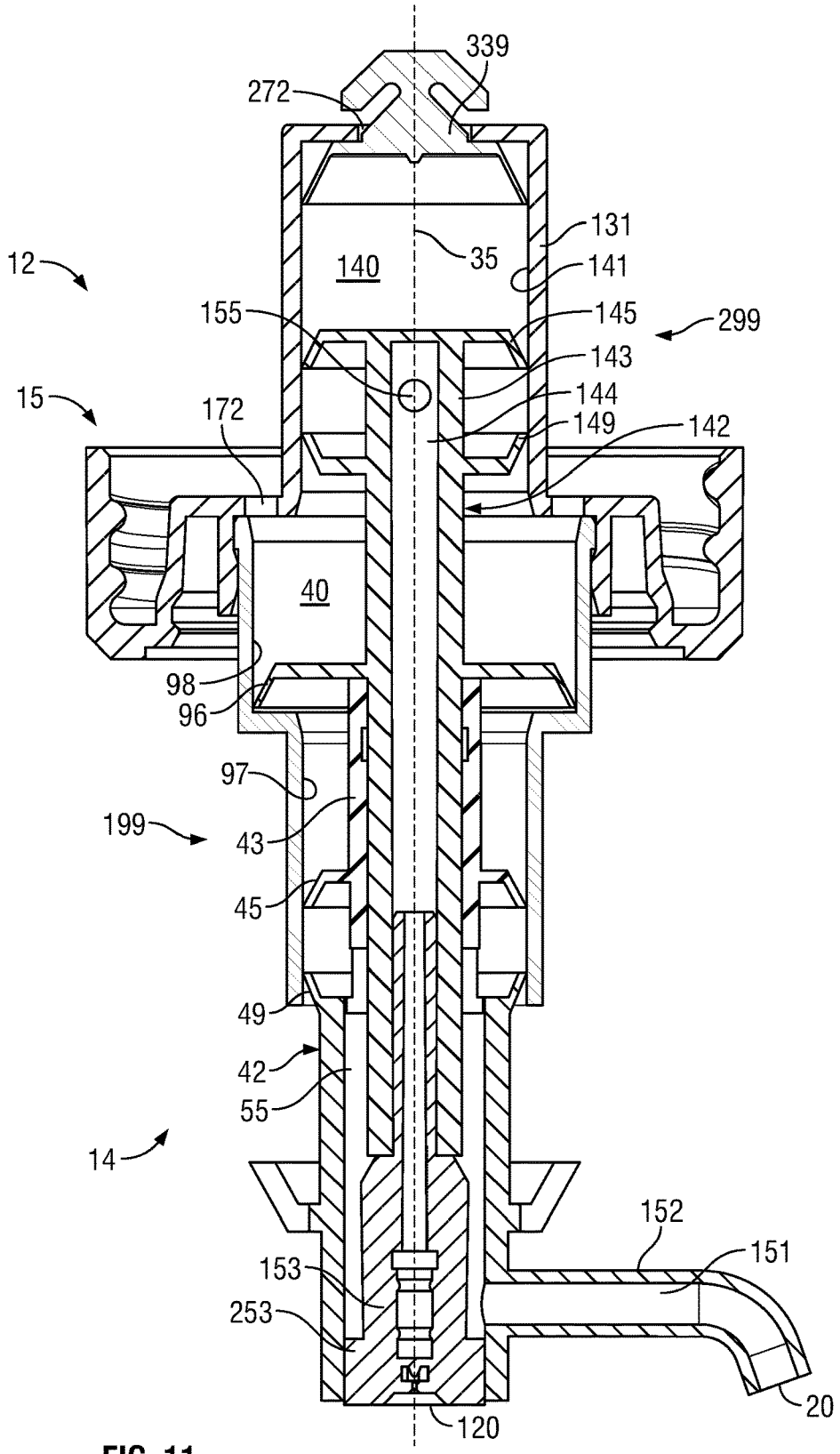
FIG. 11 is a cross-sectional front view of a sixth embodiment of a pump assembly in accordance with the present invention showing the piston-forming element in an extended condition relative the piston chamber-forming body.
Figure 12:
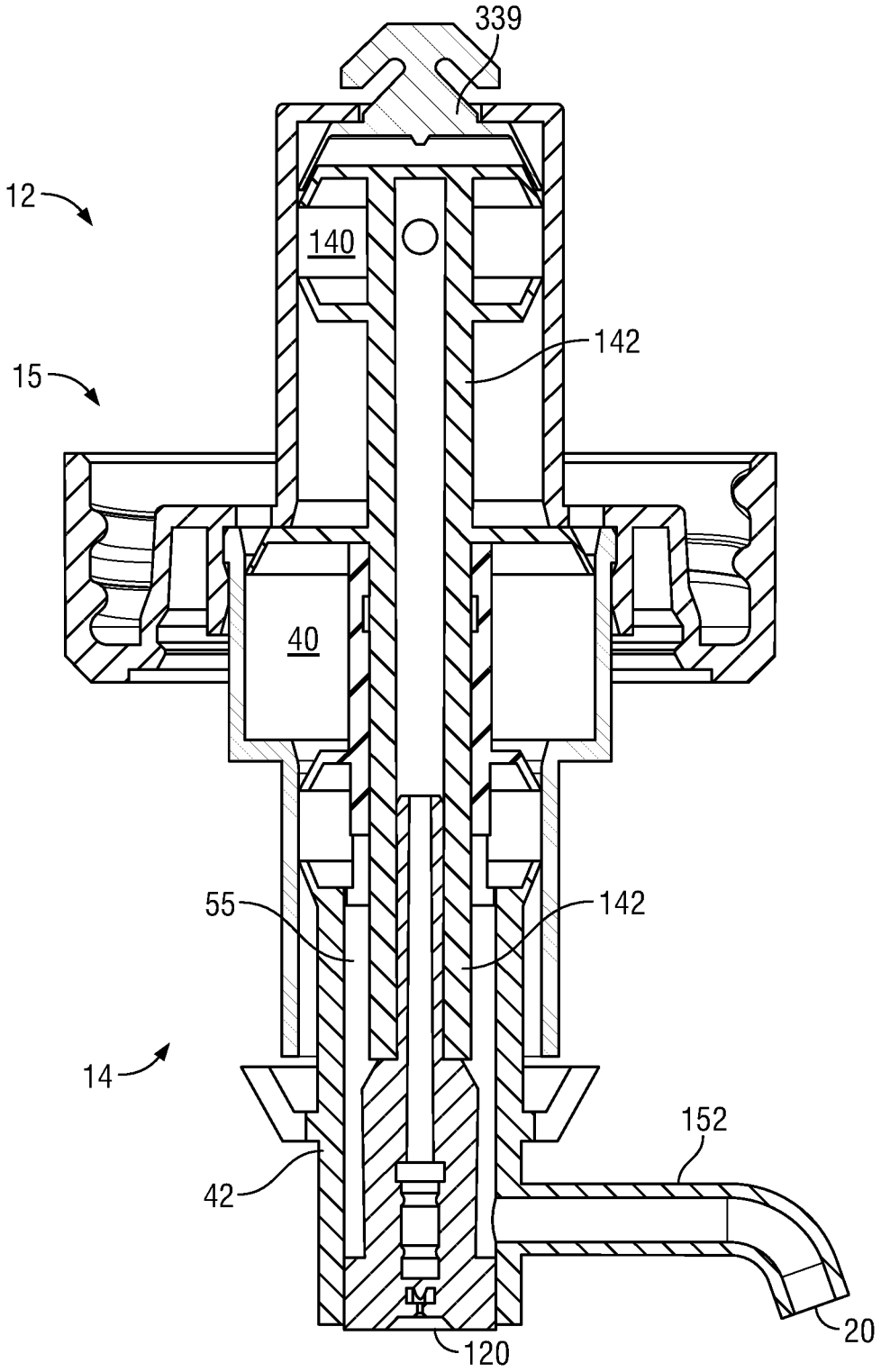
FIG. 12 is a cross-sectional front view of the pump assembly as in FIG. 11 but with the piston-forming element in a retracted condition relative the piston chamber-forming body.

The embodiment of FIG. 10 illustrates a pump arrangement in which there is discharge of a first liquid in a first interval comprising a withdrawal stroke and a discharge of a second liquid in a second interval comprising the retraction stroke. In FIG. 10, the first liquid chamber 40 and the second liquid chamber 140 are disposed in a side-by-side parallel arrangement about first axis 70 and second axis 170 parallel to each other. Reference is made to FIGS. 11 and 12 which illustrate a sixth embodiment of a pump assembly 12 in accordance with the present invention. In the embodiment of FIGS. 11 and 12 as in FIG. 10, the pump assembly 12 also provides for discharge of a first liquid in a first interval comprising the withdrawal stroke and discharge of a second liquid in a second interval comprising a retraction stroke. In FIGS. 11 and 12, however, a stepped first liquid pump 199 functionally similar to the first liquid pump 199 shown in FIG. 10 is coaxially disposed about a second liquid pump 299 functionally similar to the second liquid pump 299 shown in FIG. 10.

Referring to FIGS. 11 and 12, the piston chamber-forming body 15 provides a second liquid chamber 140 within a second tube 131 having an inner wall 141 which is generally cylindrical. At the inner end of the first liquid chamber 40 there is provided an inlet opening 272 to a reservoir with a one-way inlet valve 339 providing for fluid flow merely axially outwardly. The piston-forming element 14 carries a second liquid piston 142 having a hollow stem 143 with a central passageway 144 to provide communication from a second port 155 to a second discharge outlet 120. A spray nozzle 153 is provided at the second discharge outlet 120 for discharge of liquid as a spray. The second liquid piston 142 carries a second inner disc 145 and a second outer disc 149. The second inner disc 145 permits fluid flow merely axially outwardly therepast. The second outer disc 49 prevents fluid flow axially inwardly and outwardly therepast. The second port 155 is axially between the second inner disc 145 and the second outer disc 149. The second liquid piston 142 with the piston chamber-forming body 15 defines the second liquid pump 299 which discharges liquid from the second discharge outlet 120 in a second interval comprising a retraction stroke.

The piston chamber-forming body 15 defines a stepped first liquid chamber 40 having a cylindrical enlarged first inner portion 98 of a first diameter and a cylindrical first outer portion 97 of a lesser diameter. An inlet 172 is provided through the piston chamber-forming body 15 to the axially inner end of the first liquid chamber 40.

The piston-forming element 14 provides a first liquid piston 42 with an enlarged interior disc 96 coaxially received within the enlarged first inner portion 98 of the first liquid chamber 40 to permit fluid flow therepast merely axially outwardly. The first liquid piston 42 carries a first inner disc 45 and a first outer disc 49 both received within the reduced diameter first outer portion 97 of the first liquid chamber 40 extending radially outwardly. The first inner disc 45 provides a one-way valve merely permitting liquid flow axially outwardly therepast. The first outer disc 49 prevents fluid flow axially therepast inwardly and outwardly in the first liquid chamber 40. The first liquid piston 42 has a hollow stem 43 coaxially about the hollow stem 143 of the second liquid piston 142. An annular passageway 55 is provided within the first hollow stem 43 radially outwardly of the second hollow stem 143 which passageway 55 is open at an inner end into the first liquid chamber 40 and is closed at an axial outer end by a plug member 253 of the spray nozzle 153. A radially extending discharge tube 152 is carried on the first stem 43 and provides a passage 151 that extends radially outwardly from the passageway 55 to a first discharge outlet 20. The first liquid piston 42 and the first liquid chamber 40, in effect, provide the stepped first liquid pump 199 which discharges liquid in a first interval during a cycle of operation comprising a withdrawal stroke. The second liquid piston 142 and the second chamber 140 effectively provide the second liquid pump 299 which provides for discharge from the second discharge outlet 120 during a second interval comprising the retraction stroke.

In the embodiment of FIGS. 11 and 12, inlet 272 is provided to the second liquid chamber 140 and inlets 172 are provided to the first liquid chamber 40. In the embodiment of FIGS. 11 and 12, both the second inlet 272 and the first inlets 172 are shown as adapted to be opened into a single reservoir. However, it is to be appreciated that two reservoirs may be arranged so as to provide liquid from a first reservoir to the first inlets 172 and liquid from a second reservoir to the second inlets 272.

Figure 13:
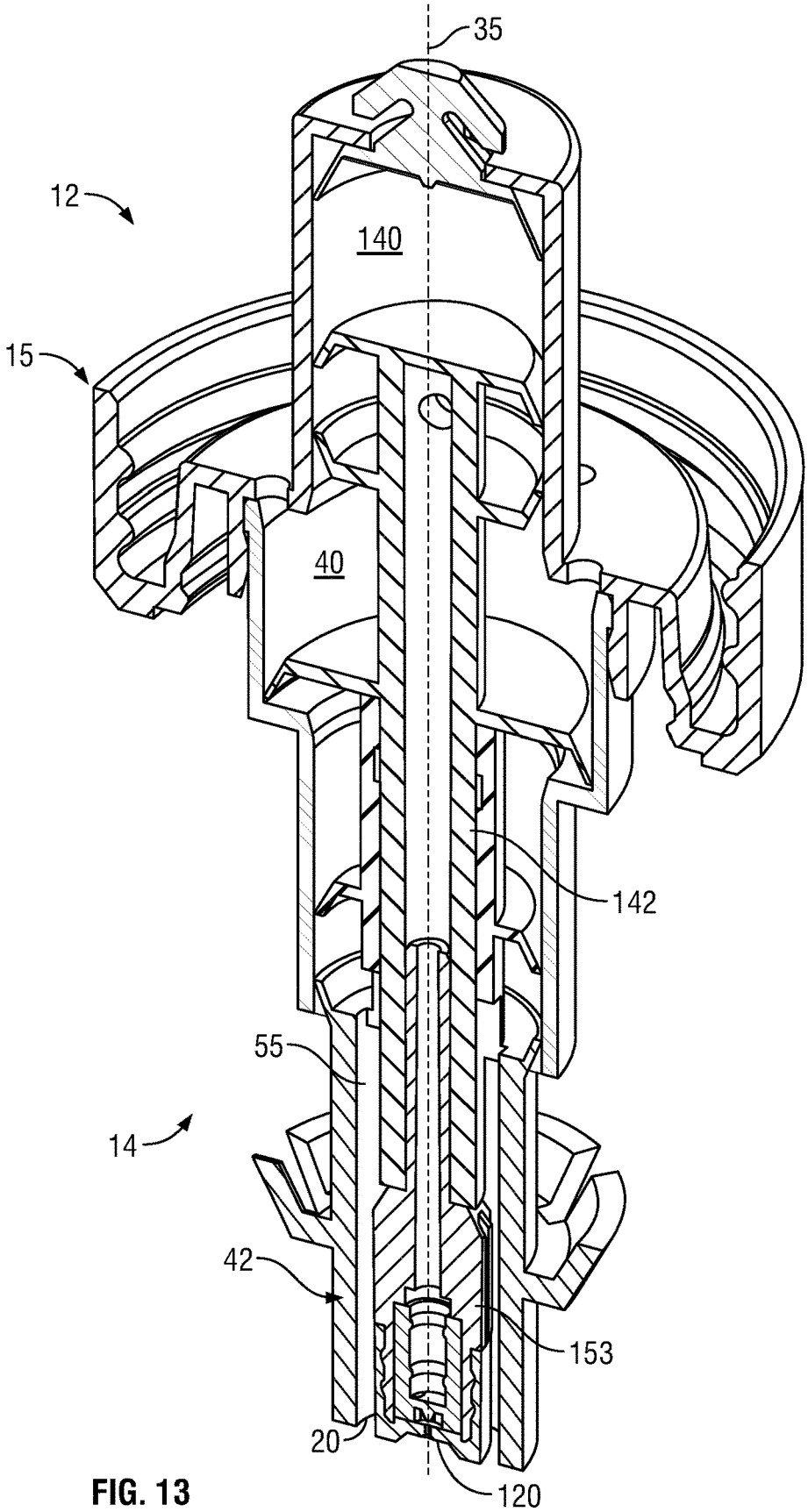
FIG. 13 is a pictorial cross-sectional front view of a seventh embodiment of a pump assembly in accordance with the present invention showing the piston-forming element in an extended condition relative the piston chamber-forming body.

Reference is made to FIG. 13 which shows the seventh embodiment of a pump assembly 12 in accordance with the present invention. The embodiment of FIG. 13 is identical to the embodiment illustrated in FIGS. 11 and 12 with the exception that, whereas in FIGS. 11 and 12, the annular first discharge passageway 55 is blocked by a plug member 253 for discharge through a radially extending discharge tube 152 to the first discharge outlet 20, in contrast in FIG. 13, the annular discharge passageway 55 extends axially outwardly annularly about the stem 143 to an annular first discharge outlet 20 coaxial about the center axis 35.

In each of the embodiments of FIGS. 11, 12 and 13, a spray nozzle 153 is shown. The spray nozzle 153 may be eliminated such that there is discharge from both the first discharge outlet 20 and the second discharge outlet 120 as a liquid stream. Similarly, two spray nozzles may be provided such that there is liquid spray discharged from both the first discharge outlet 20 and the second discharge outlet 120.

Figure 14:
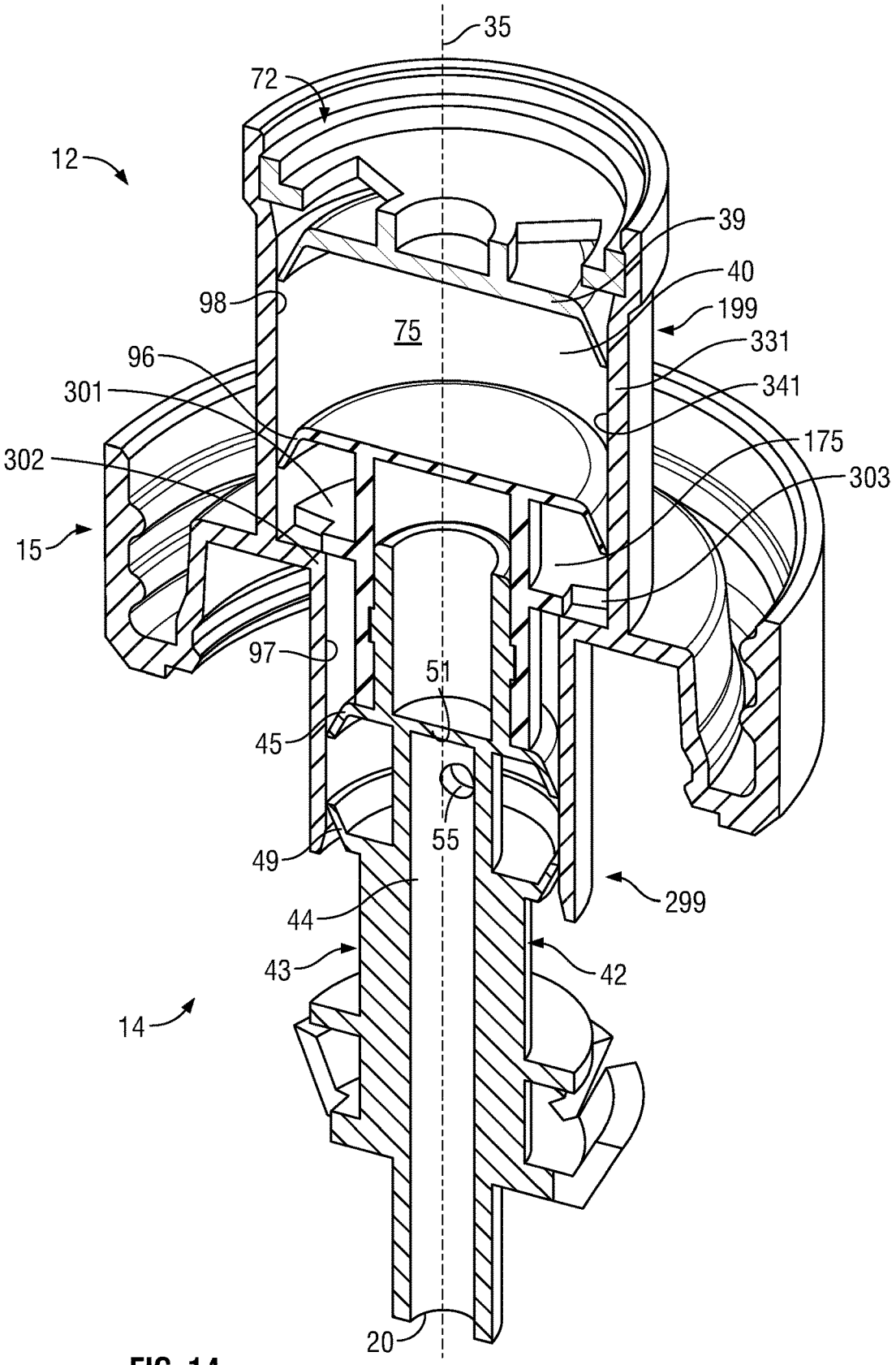
FIG. 14 is a pictorial cross-sectional front view of an eighth embodiment of a pump assembly in accordance with the present invention showing the piston-forming element in an extended condition relative the piston chamber-forming body.
Figure 15:
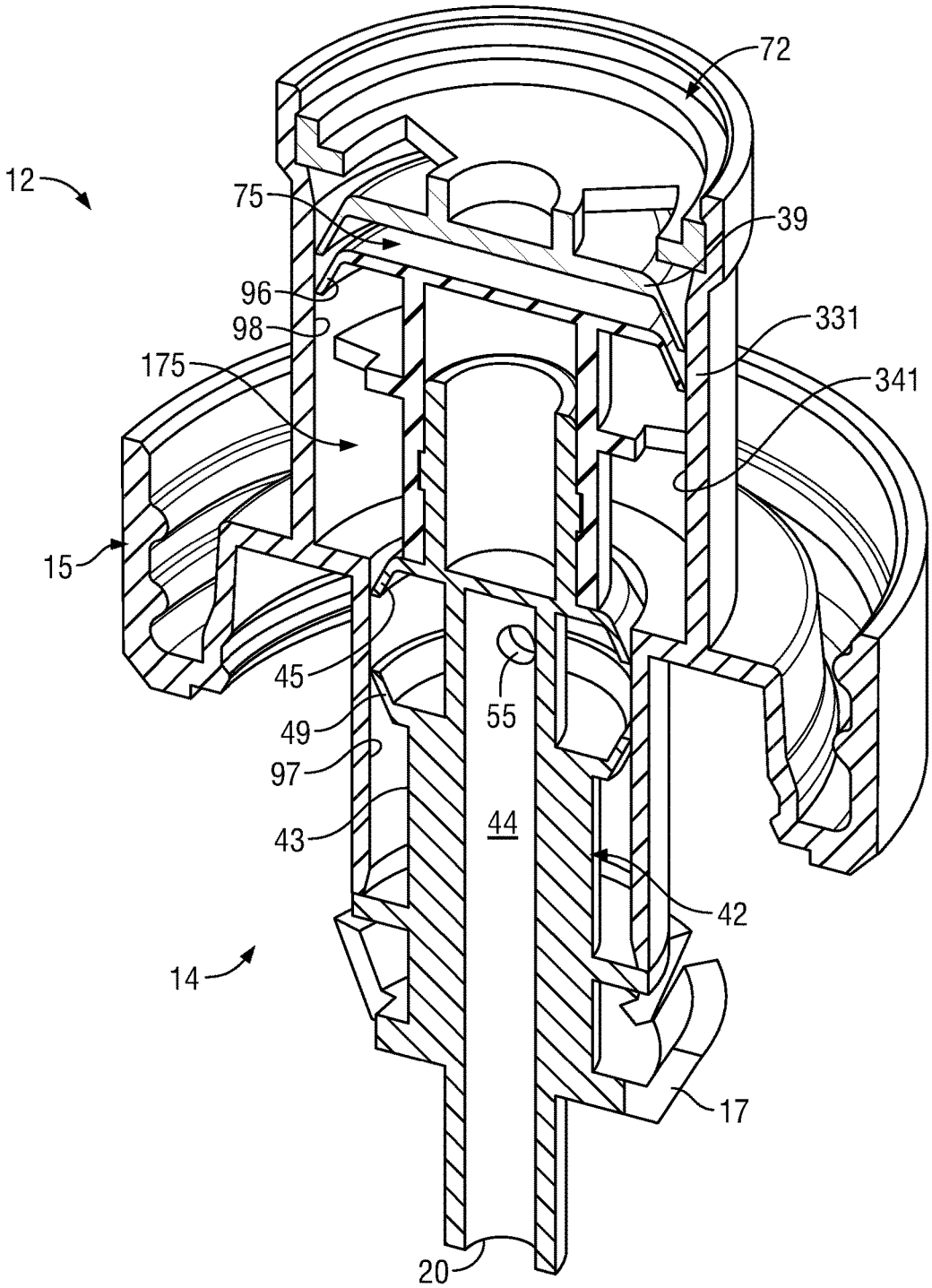
FIG. 15 is a pictorial cross-sectional front view of the pump assembly of FIG. 14 but with the piston-forming element in a retracted condition relative the piston chamber-forming body.

Reference is made to FIGS. 14 and 15 which illustrate an eighth embodiment of a pump assembly 12 in accordance with the present invention. The embodiment of FIGS. 14 and 15 has similarities to the embodiment of FIG. 10 with the spray nozzle 153 removed. In the configuration of FIG. 10, a first liquid pump 199 and a second liquid pump 299 are provided out of phase with one discharging liquid in a retraction stroke and the other discharging liquid in a withdrawal stroke, and a similar arrangement of two out of phase liquid pumps are provided in FIGS. 14 and 15. However, in FIG. 10, there is discharge of liquid from two separate liquid discharge outlets 20 and 120. In the embodiment of FIGS. 14 and 15, a first liquid pump 199 and a second liquid pump 299 are provided, each adapted to draw liquid from the same inlet 72, however, in contrast to FIG. 10, in FIGS. 14 and 15, the two liquid pumps discharge liquid from the same discharge outlet 20. In FIG. 10, the two pumps are disposed about parallel side by side spaced axis 70 and 170 while, in contrast in FIGS. 14 and 15, the first liquid pump 199 and the second liquid pump 299 are coaxially disposed about a center axis 35.

In FIGS. 14 and 15, the piston chamber-forming body 15 has a stepped tube 331 with an inner wall 341 having a cylindrical enlarged inner portion 98 of a first diameter and a cylindrical outer portion 97 of a lesser diameter. An inner end of the inner portion 98 opens into a liquid containing reservoir and provides an inlet 72. A one-way inlet valve 39 is provided across the inlet 72 to permit merely fluid flow axially outwardly therepast. A stepped liquid chamber 40 is defined within the stepped tube 331 open via the inlet 72 to the reservoir. The piston-forming element 14 has a liquid piston 42 with a stem 43. An enlarged interior disc 96 extends radially outwardly from an axially inner end of the stem 43 into engagement with the wall 341 within the enlarged inner portion 98. The interior disc 96 is coaxially received within the enlarged inner portion 98 to permit fluid flow therepast merely axially outwardly.

Axially outwardly from the interior disc 96, the liquid piston 42 carries a stop flange 301 which serves to engage an axially inwardly directed shoulder 302 of the tube 331 to limit axial sliding of the liquid piston 42 axially outwardly.

Axially extending openings 303 are provided through the stop flange 301 to permit fluid flow axially therepast.

The liquid piston 42 carries on the stem 43 an inner disc 45 and an outer disc 49, both received within the reduced diameter outer portion 97 and extending radially outwardly from the stem 43 into engagement with the wall 341. The first inner disc 45 provides a one-way valve merely permitting liquid flow axially outwardly therepast. The first outer disc 49 prevents fluid flow axially therepast inwardly and outwardly.

The liquid piston 42 has a central passageway 44 within the stem 43 to provide communication from a port 55 to a discharge outlet 20. The passageway 44 is closed at an inner end 51. The port 55 is open through the stem 43 into an annular space between the inner disc 45 and the outer disc 49. A variable volume inner liquid compartment 75 is defined within the inner portion 98 between the interior disc 96 and the one-way valve 39. A cycle of operation comprises a retraction stroke and a withdrawal stroke. The volume of the inner liquid compartment 75 decreases in a retraction stroke and increases in a withdrawal stroke. A variable volume second liquid compartment 175 is defined within the tube 331 between the interior disc 96 and the outer disc 49. The volume of the second liquid compartment 175 increases in a withdrawal stroke and decreases in a retraction stroke.

From the extended position of FIG. 14, the retraction stroke involves movement from the position of FIG. 14 to the position of FIG. 15. In the retraction stroke, the volume of the first liquid compartment 75 decreases and the volume of the second liquid compartment 175 increases. However, the volume decrease of the first liquid compartment 75 is greater than the volume increase of the second liquid compartment 175 whereby the result is that liquid is forced past the inner disc 45 through the port 55 and the passageway 44 to the discharge from the discharge outlet 20.

In a withdrawal stroke, on moving from the retracted position of FIG. 15 to the extended position of FIG. 14, the volume of the first liquid compartment 75 increases drawing liquid from the reservoir past the one-way inlet valve 39. At the same time, the volume of the second liquid compartment 175 decreases forcing liquid past the first disc 45 and via the port 55 and passageway 44 to be discharged out the discharge outlet 20. Thus, in operation of the pump assembly 12, in both a withdrawal stroke and a retraction, there is discharge of liquid from the discharge outlet 20.

In the eighth embodiment of FIGS. 14 and 15, the stepped liquid chamber 40 formed in the stepped tube 331 has the axially inner portion 98 of a larger diameter and the axially outer portion 97 of a lesser diameter. This arrangement has a number of advantages. As one advantage, the piston-forming element 14 cannot be removed from the piston chamber-forming body 15 by drawing the piston-forming element 14 axially outwardly since, in the fully extended position, the stop flange 301 engages the shoulder 302. As well, in the fully extended position, engagement of the stop flange 310 with the shoulder 302 in a sealed manner can prevent liquid flow axially outwardly therepast as can be advantageous, for example, to prevent liquid discharge during shipping and between cycles of operation.

Figure 16:
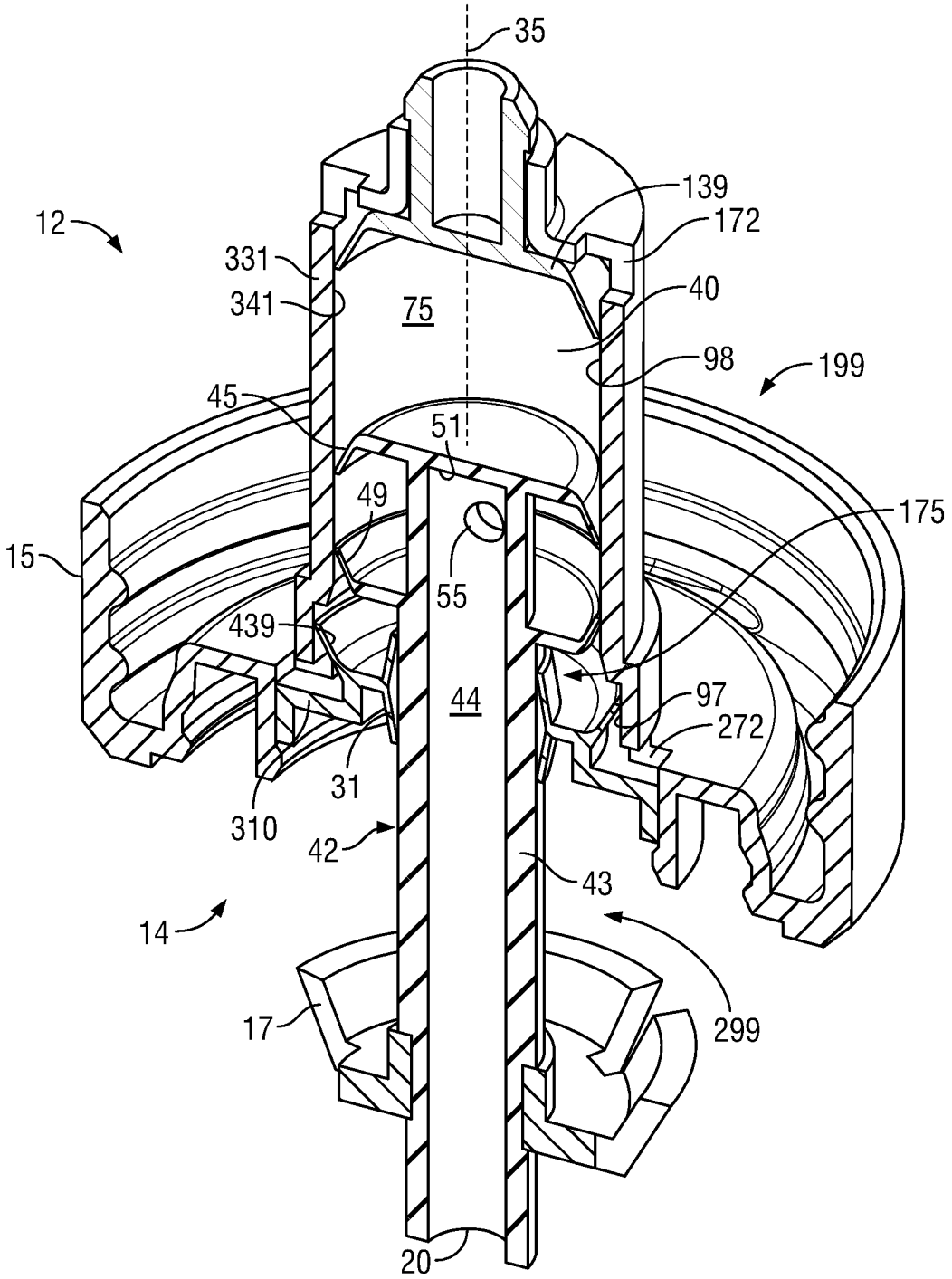
FIG. 16 is a pictorial cross-sectional front view of a ninth embodiment of a pump assembly in accordance with the present invention showing the piston-forming element in an extended condition relative the piston chamber-forming body.
Figure 17:
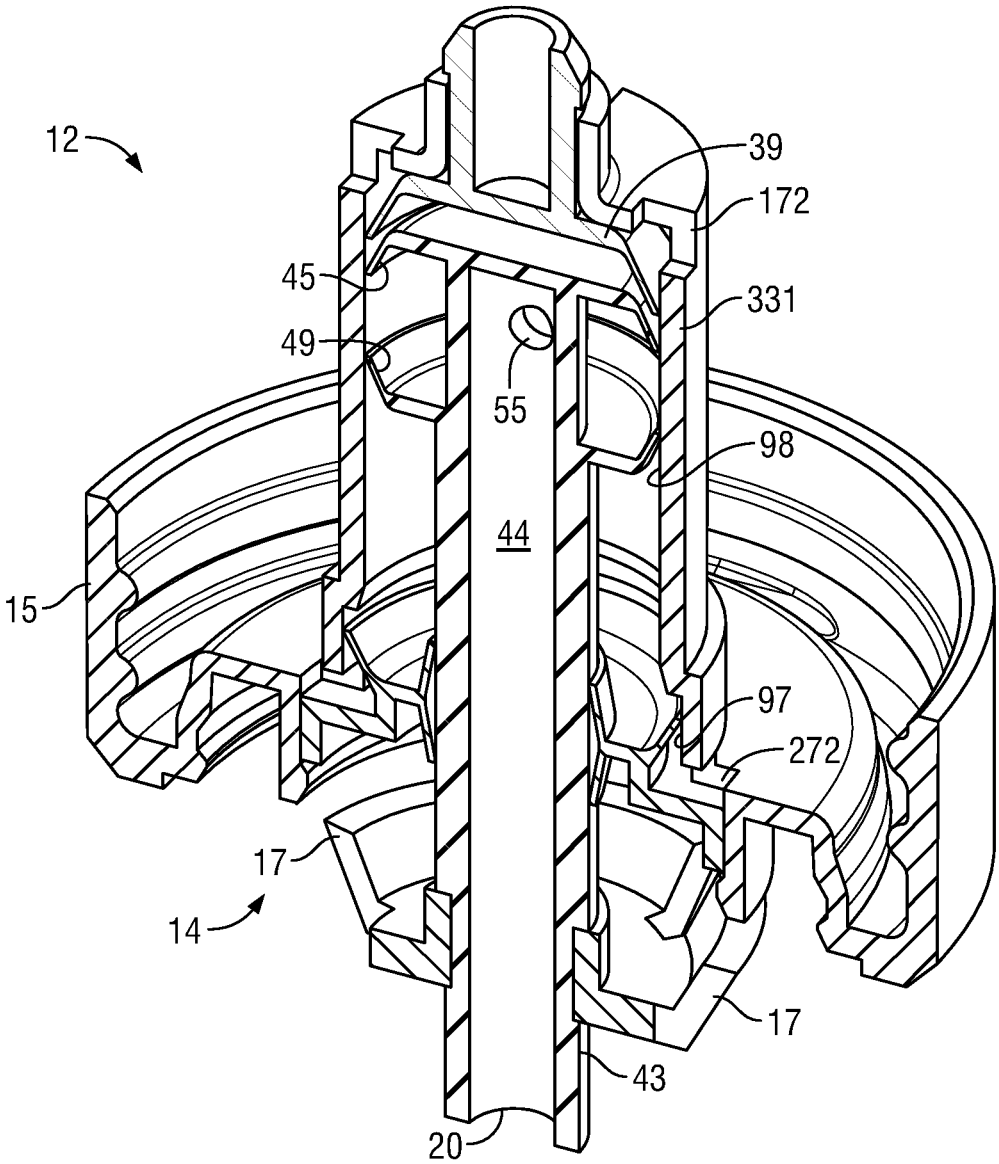
FIG. 17 is a pictorial cross-sectional front view of the pump assembly of FIG. 16 but with the piston-forming element in a retracted condition relative the piston chamber-forming body.

Reference is made to FIGS. 16 and 17 which illustrate a ninth embodiment of a pump assembly 12 in accordance with the present invention which has similarities to the eighth embodiment of FIGS. 14 and 15, however, in the ninth embodiment of FIGS. 16 and 17, a stepped liquid chamber 40 is formed in a stepped tube 331 so as to have a cylindrical axially inner portion 98 of a first diameter and a cylindrical axially outer portion 97 with a diameter greater than the first diameter.

In FIGS. 16 and 17, the piston-forming element 14 includes the tube 331 with an inner wall 341 which is stepped to provide the cylindrical reduced inner portion 98 and the cylindrical enlarged outer portion 97. The stepped liquid chamber 40 is defined within the tube 331. At an axially inner end, the liquid chamber 40 is open via a first inlet 172 to a reservoir and a first one-way valve 139 is provided across the first inlet 172 to provide merely liquid flow axially outwardly.

At an axially outer end of the liquid chamber 40 at the axially outer end of the outer portion 97, a sealing flange 310 is provided fixedly secured to the piston chamber-forming body 15 against axial movement relative the piston chamber-forming body 15. Second inlets 172 are provided through the tube 331 at circumferentially spaced locations about the outer portion 97 to place the outer portion 97 into communication with liquid within the reservoir. The sealing flange 310 carries a second one-way valve 439 comprising an axially inwardly and radially outwardly directed disc for engagement with the inner wall 341 of the outer portion 97 axially inwardly of the second inlets 172 to provide for merely liquid flow axially inwardly therepast and to prevent liquid flow axially outwardly. The sealing flange 310 carries at a radially inner end a pair of sealing discs 311 which engage a cylindrical radially outwardly directed surface of the stem 43 of the piston 42 to provide a seal preventing flow axially inwardly or outwardly therebetween as the piston-forming element 14 slides axially relative to the piston chamber-forming body 15.

The piston-forming element 14 comprises the liquid piston 42 having a hollow stem 43 with a passageway 44 coaxially therethrough from a closed inner end 51 to a discharge outlet 20. The liquid piston 42 carries on the stem 43 an inner disc 45 and an outer disc 49, each of which extend radially outwardly from the stem 43 into engagement with the wall 341 in the inner portion 98. The inner disc 45 provides a one-way valve merely permitting liquid flow axially outwardly therepast. The outer disc 49 provides a one-way valve merely permitting liquid flow axially inwardly therepast preventing fluid flow axially outwardly therepast. A port 55 provides communication from an annular space about the stem 43 between the first disc 45 and the second disc 49 into the central passageway 44.

An engagement flange 17 is secured to the piston 42.

Operation of the embodiment of FIGS. 16 and 17 involves a cycle of operation comprising a retraction stroke and an extension stroke. A variable volume of first liquid compartment 75 is defined within the inner portion 98 between the outer disc 49 and the one-way valve 39. The first liquid compartment 75 increases in volume in the withdrawal stroke and decreases in volume in the retraction stroke.

A variable volume second liquid compartment 175 is defined within the tube 331 between the inner disc 45 and the sealing flange 310 annularly about the stem 43 of the piston 42. The volume of the second liquid compartment 175 increases in the retraction stroke and decreases in the withdrawal stroke.

A cycle of operation includes the retraction stroke in moving from the position of FIG. 16 to the position of FIG. 17 and the withdrawal stroke in moving from the position of FIG. 17 to the position of FIG. 16. In the retraction stroke, in moving from the position of FIG. 16 to the position of FIG. 17: the volume of the first liquid compartment 75 is decreased forcing liquid past the first disc 45 through the port 55 and the passageway 44 to exit the discharge outlet 20; and the volume of the second liquid compartment 175 is increased drawing liquid from the reservoir past the second one-way inlet valve 439. In the withdrawal stroke, in moving from the position of FIG. 17 to the position of FIG. 16, the volume of the first liquid compartment 75 is increased drawing liquid from the reservoir past the first one-way inlet valve 139; and the volume of the second liquid compartment 175 is decreased forcing liquid past the outer disc 49 through the port 55 and the passageway 44 to exit the discharge outlet 20. Thus, liquid is discharged from the discharge outlet 20 at all times during both the withdrawal stroke and the retraction stroke.

In the embodiment of FIGS. 16 and 17, the first liquid pump 199 and the second liquid pump 299 are provided, with the first liquid pump 199 adapted to draw liquid from the first inlet 172 and the second liquid pump 199 adapted to draw liquid from the second inlet 272. In FIGS. 16 and 17, the two liquid pumps 199 and 299 discharge liquid from the same discharge outlet 20.

In the embodiments of FIGS. 14 to 17, there is provided a piston pump arrangement comprising a first liquid pump and a second liquid pump coaxially arranged about a central axis. One of the pumps comprises a stepped chamber liquid pump. In the embodiment of FIGS. 14 and 15, one of the pumps draws liquid from a reservoir and provides discharged liquid of which a first portion is provided as input liquid to the other pump and a second portion is discharged from a discharge outlet.

In each of the embodiments of FIGS. 1 to 12 and, as readily seen in FIG. 1, the first discharge outlet 20 is spaced from the second discharge outlet 120, in the case of the figures radially relative the axis 35, and forwardly to rearwardly relative the front and rear of the dispenser 10. This spacing is advantageous to assist in directing the liquid spray 121 onto the ends of the finger 630 and the fingertips 631 and the liquid stream 21 onto the palm 632. While spacing of the discharge outlets 20 and 120 is preferred, the two discharge outlets need not be spaced and, for example, may be coaxial. Preferably, in any event, the spray discharge outlet 120 discharges the liquid spray 121 directionally towards the fingertips 631 and the liquid discharge outlet 20 displays the liquid stream 21 directionally toward the palm 632 as may be accomplished by the use of directional nozzles.

The invention has been described with reference to a preferred embodiment in FIG. 1 illustrating the manually operated dispenser. The invention is adapted for use with automated electronically operated dispensers which may, for example, be touchless.

The invention has been illustrated in the embodiments of FIGS. 1 to 13 with reference to a dispenser which dispenses the liquid and spray downwardly. This is preferred in assisting a person in placing their fingertips horizontally spaced from the palm of a hand and which the palm of the hand is adapted to receive the liquid stream. The dispenser illustrated in FIG. 1 shows the reservoir disposed above each discharge outlet, however, this is not necessary.

The preferred embodiments in FIGS. 1 to 13 illustrate the use of piston pumps for dispensing the liquid stream and the spray stream. The use of piston pumps is not necessary and dispensing of a liquid stream and a spray stream may be arranged by the use of other pump mechanisms.

The embodiment of FIG. 9 illustrates an arrangement in which an air pump is provided for simultaneous dispensing of air with liquid from the first chamber 40. Other arrangements may be adopted in which air may also be simultaneously dispensed with dispensing of liquid from the second chamber 140 as can be advantageous to provide an enhanced mist or spray 121. A separate first air pump may be provided for dispensing air with the liquid from the liquid chamber 40 and a separate second air pump may be provided for dispensing air with the liquid from the liquid chamber 140.

The embodiment of FIGS. 7 and 9 illustrate the use as a foam inducing member of a screen. The particular nature of the foam inducing member is not limited. Preferred foam inducing members have relatively small opening through which a liquid and air are forced to produce foam. The foam inducing member may comprise, for example, a screen of plastic or metal; a mesh; a batting a bonded fibres, a porous body formed as by sintering; and a porous form of plastic material, for example, open celled foamed plastics. The foam inducing member preferably generates turbulence in the fluid passing there through to generate foam when air and a liquid are simultaneously passed through the porous member. In the embodiment of FIG. 7, the foam inducing member is a single screen. However, the foam inducing member may comprise a number of foam inducing elements. For example, as comprising two spaced screens with a porous plug between them.

The preferred embodiments of FIGS. 1 to 13 show the provision of two outlets 20 and 120. However, three or more outlets may be provided for selectively timed discharge of one, two or more cleaning liquids as a liquid stream, a liquid spray, a foamed mixture of liquid and air and/or a spray mixture of liquid and air. For example, providing three or more outlets may permit location and direction of two or more spray outlets to assist in ensuring application of the cleaning liquid to the fingertips of a person's hand without excess overspray.

While the invention has been described with reference to preferred embodiments, many variations and modifications will occur to these skilled in the art and for a definition of the invention reference is made to the claims.

We claim:

1. A piston pump arrangement for dispensing a liquid from at least one discharge outlet comprising:

the pump arrangement including a piston-forming element coaxially reciprocally slidable along an axis within a piston chamber-forming body between a retracted position and a withdrawn position in a cycle of operation in which movement from the retracted position to the withdrawn position is a withdrawal stroke and movement from the withdrawn position to the retracted position is a retraction stroke, the piston chamber-forming body including an inner chamber coaxial about the axis having a cylindrical chamber wall, an inner end and an open outer end, the inner end of the inner chamber in communication with a reservoir of the liquid to be dispensed via a first liquid inlet, a one-way inlet valve across the first liquid inlet permitting liquid flow from the reservoir to into the inner chamber but preventing liquid flow from the inner chamber to the reservoir, the piston chamber-forming body including a stepped outer chamber coaxial about the axis having a chamber wall, an open inner end and an open outer end, the open outer end of the inner chamber opening axially outwardly into the open inner end of the outer chamber, the chamber wall of the outer chamber having a cylindrical inner portion having a diameter and a cylindrical outer portion having a diameter which is less than the diameter of the cylindrical inner portion, the cylindrical inner portion opening axially outwardly into the cylindrical outer portion, the piston-forming element having an inner end and an outer end, the piston-forming element coaxially received within the piston chamber-forming body with the inner end of the piston-forming element within the inner chamber and the outer end of the end piston-forming element extending axially outwardly from the open outer end of the outer chamber, the piston-forming element having a central stem coaxially about the axis with at least one passageway within the stem extending axially outwardly from a closed inner end to an outer outlet end at the outer end of the end piston-forming element in communication with the at least one discharge outlet, a first inner disc extending radially outwardly from the stem into engagement with the chamber wall of the inner chamber to permit liquid flow axially outwardly therepast but prevent liquid flow axially inwardly therepast, a first outer disc extending radially outwardly from the stem into engagement with the chamber wall of the inner chamber to prevent liquid flow axially inwardly and outwardly therepast, the first outer disc located on the stem spaced axially outwardly from the first inner disc, a first port on the stem axially between the first inner disc and the first outer disc providing communication radially through the stem to the passageway, a sealing disc extending radially outwardly from the stem into engagement with the cylindrical inner portion of chamber wall of the outer chamber to prevent liquid flow axially inwardly and outwardly therepast, the sealing disc located on the stem spaced axially outwardly from the first outer disc, a second inner disc extending radially outwardly from the stem into engagement with the cylindrical outer portion of chamber wall of the outer chamber to permit liquid flow axially outwardly therepast but prevent liquid flow axially inwardly therepast, the second inner disc located on the stem spaced axially outwardly from the sealing disc, a second outer disc extending radially outwardly from the stem into engagement with the cylindrical outer portion of chamber wall of the outer chamber to prevent liquid flow axially inwardly and outwardly therepast, the second outer disc located on the stem spaced axially outwardly from the second inner disc, a second port on the stem axially between the first outer disc and the second outer disc providing communication radially through the stem to the passageway, a variable volume first liquid compartment defined in the inner chamber between the one-way inlet valve and the first outer disc, the first liquid compartment having a volume that increases in the withdrawal stroke drawing liquid from the reservoir through the first liquid inlet past the one-way inlet valve into the first liquid compartment, the volume of the first liquid compartment decreases in the retraction stroke forcing liquid axially outwardly past the first inner disc to between the first inner disc and the second inner disc to the first port, through the first port into the passageway and via the passageway to the at least one discharge outlet, a variable volume second liquid compartment defined in the outer chamber between the sealing disc and the second outer disc, the piston-forming element having a second liquid inlet placing the second liquid compartment in communication with the reservoir, the second liquid compartment having a volume that increases in the reaction stroke drawing liquid from the reservoir through the second liquid inlet past the sealing disc into the second liquid compartment, the volume of the second liquid compartment decreases in the withdrawal stroke forcing the liquid axially outwardly past the second inner disc to between the second inner disc and the second outer disc to the second port and through the second port into the passageway and via the passageway to the at least one discharge outlet.

2. A piston pump arrangement as claimed in claim 1 wherein the at least one outlet comprises a first outlet and a second outlet, at least one passageway comprising a first passageway and a second passageway, the first passageway placing the first port and the first discharge outlet in communication, the second passageway placing the second port and the second discharge outlet in communication.

3. A piston pump arrangement as claimed in claim 2 wherein:

a spray nozzle provided at a first one of the first discharge outlet and the second discharge outlet to discharge the liquid passing therethrough as a spray, and a stream nozzle provided at the first discharge outlet and the second discharge outlet that is not the first one of the first discharge outlet and the second discharge outlet, to discharge the liquid passing therethrough as a fluid stream.

4. A piston pump arrangement as claimed in claim 3 wherein the liquid is a hand cleaning fluid, the pump arrangement is provided to dispense the hand cleaning fluid onto a person's hand disposed proximate the at least one discharge outlet in the cycle of operation comprising the withdrawal stroke and the retraction stroke.

5. A piston pump arrangement as claimed in claim 4 wherein:

with a palm of the hand facing the stream nozzle such that the stream nozzle directs the liquid as the liquid stream onto the palm of the hand, the spray nozzle directs the liquid as the spray towards fingertips of the hand.

6. A piston pump arrangement as claimed in claim 5 wherein the spray nozzle is at a first location and the stream nozzle is at a second location spaced from the first location such that when the hand of the person is located with the palm of the hand underneath the stream nozzle and directed upwardly toward the stream nozzle, the stream nozzle directs the liquid stream onto the palm, the spray nozzle is above the fingertips of the hand and nearer to the fingertips of the hand than the stream nozzle in a position to direct the liquid spray onto the fingertips.

7. A piston pump arrangement as claimed in claim 6 wherein the second location is spaced radially relative the axis from the first location.

8. A piston pump arrangement for dispensing a liquid from a discharge outlet comprising:

the pump arrangement including a piston-forming element coaxially reciprocally slidable along an axis within a piston chamber-forming body between a retracted position and a withdrawn position in a cycle of operation in which movement from the retracted position to the withdrawn position is a withdrawal stroke and movement from the withdrawn position to the retracted position is a retraction stroke, the piston chamber-forming body including a stepped chamber coaxial about the axis having a chamber wall, an open inner end and an open outer end, the stepped chamber having a cylindrical inner chamber portion opening axially outwardly into a cylindrical outer chamber portion, the chamber wall of the chamber having in the inner chamber portion a cylindrical inner wall portion having a diameter and in the outer chamber portion a cylindrical outer wall portion having a diameter which is less than the diameter of the cylindrical inner wall portion, the inner end of the chamber in communication with a reservoir of the liquid to be dispensed via a liquid inlet, a one-way inlet valve across the liquid inlet permitting liquid flow from the reservoir into the inner chamber portion of the chamber but preventing liquid flow from the inner chamber portion of the chamber to the reservoir, the piston-forming element having an inner end and an outer end, the piston-forming element coaxially received within the piston chamber-forming body with the inner end of the piston-forming element within the inner chamber portion of the chamber and the outer end of the end piston-forming element extending axially outwardly from the open outer end of the chamber, the piston-forming element having a central stem coaxially about the axis with a passageway within the stem extending axially outwardly from a closed inner end to an outer outlet end at the outer end of the end piston-forming element in communication with the discharge outlet, a driving disc extending radially outwardly from the stem into engagement with the inner wall portion of the chamber wall to permit liquid flow axially outwardly therepast but prevent liquid flow axially inwardly therepast, an inner disc extending radially outwardly from the stem into engagement with the outer wall portion of the chamber wall to permit liquid flow axially outwardly therepast but prevent liquid flow axially inwardly therepast, the inner disc located on the stem spaced axially outwardly from the driving disc, an outer disc extending radially outwardly from the stem into engagement with the outer wall portion of the chamber wall to prevent liquid flow axially inwardly and outwardly therepast, the outer disc located on the stem spaced axially outwardly from the inner disc, a port on the stem axially between the inner disc and the outer disc providing communication radially through the stem to the passageway, a variable volume first liquid compartment defined in the inner chamber portion of the chamber between the one-way inlet valve and the driving disc, the first liquid compartment having a volume that increases by a first volume in the withdrawal stroke drawing liquid from the reservoir through the liquid inlet past the one-way inlet valve into the first liquid compartment, the volume of first liquid compartment decreases by the first volume in the retraction stroke forcing liquid axially outwardly from between the one-way inlet valve and the driving disc past the driving disc, a variable volume second liquid compartment defined in the chamber between the driving disc and the outer disc, the second liquid compartment having a volume that decreases by a second volume in the withdrawal stroke forcing liquid between the driving disc and the inner disc past the inner disc to between the inner disc and the outer disc to the port, through the port into the passageway and via the passageway to the discharge outlet, the volume of the second liquid compartment increases by the second volume in the retraction stroke drawing liquid axially outwardly past the driving disc to between the driving disc and the inner disc, wherein the first volume is greater than the second volume such that in the retraction stroke the liquid in a volume equal to the difference between the first volume and the second volume is discharged from the discharge outlet and in the withdrawal stroke the liquid in a volume equal to the second volume is discharged from the discharge outlet.

9. A piston pump arrangement as claimed in claim 8 wherein the liquid is a hand cleaning fluid, the piston pump arrangement is provided to dispense the hand cleaning fluid onto a person's hand disposed proximate the discharge outlet in the cycle of operation comprising the withdrawal stroke and the retraction stroke.

* * * * *